US011926972B2

(12) United States Patent
Burton et al.

(10) Patent No.: US 11,926,972 B2
(45) Date of Patent: Mar. 12, 2024

(54) SHEAR CUTTER PICK MILLING SYSTEM

(71) Applicant: US SYNTHETIC CORPORATION, Orem, UT (US)

(72) Inventors: Regan Leland Burton, Saratoga Springs, UT (US); Andrew E. Dadson, Provo, UT (US); Mohammad N. Sani, Orem, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 17/234,400

(22) Filed: Apr. 19, 2021

(65) Prior Publication Data

US 2021/0262179 A1 Aug. 26, 2021

Related U.S. Application Data

(63) Continuation of application No. 16/406,673, filed on May 8, 2019, now Pat. No. 11,015,303, which is a continuation of application No. 14/275,574, filed on May 12, 2014, now Pat. No. 10,323,514.

(60) Provisional application No. 61/824,022, filed on May 16, 2013.

(51) Int. Cl.

| | |
|---|---|
| ***E01C 23/088*** | (2006.01) |
| ***E01C 23/12*** | (2006.01) |
| ***E21C 35/183*** | (2006.01) |

(52) U.S. Cl.

CPC ..... *E01C 23/088* (2013.01); *E01C 23/127* (2013.01); *E21C 35/183* (2013.01); *E21C 35/1833* (2020.05); *E21C 35/1835* (2020.05); *E21C 35/1837* (2020.05)

(58) Field of Classification Search

CPC ..... E21C 35/1833; E21C 35/183; E21C 35/1837; E21C 23/1835; B28D 1/186; B28D 1/188; E01C 23/088; E01C 23/127; B27G 13/00; B27G 13/02; B27G 13/04; B27G 13/06; B27G 13/08; B27G 13/10;

(Continued)

(56) References Cited

U.S. PATENT DOCUMENTS

| | | | |
|---|---|---|---|
| 2,665,893 | A | 1/1954 | Ball |
| 3,342,532 | A | 9/1967 | Krekeler et al. |
| 3,544,166 | A | 12/1970 | Proctor |

(Continued)

FOREIGN PATENT DOCUMENTS

| | | | |
|---|---|---|---|
| AU | 2013101370 | A4 | 11/2013 |
| CN | 102108866 | A | 6/2011 |

(Continued)

OTHER PUBLICATIONS

English language machine translation of Sionnet, French Patent Publication No. FR-2605676-A1, published Apr. 29, 1988 (5 pages) (Year: 1988).*

(Continued)

*Primary Examiner* — Abby J Flynn
*Assistant Examiner* — Michael A Goodwin
(74) *Attorney, Agent, or Firm* — BKRIP LLC

(57) ABSTRACT

This disclosure relates to a system for removing road material. In an embodiment, the system may include a milling drum and at least one pick mounted on the milling drum. Furthermore, the pick may include polycrystalline diamond at least partially forming one or more working surfaces of the pick.

20 Claims, 8 Drawing Sheets

(58) Field of Classification Search
CPC ..... B27G 13/12; B27G 13/14; B27G 13/16; B27G 15/00; B27G 15/02
USPC ..... 299/100, 112 T, 101, 108, 112 R; 175/427, 426
See application file for complete search history.

(56) References Cited

U.S. PATENT DOCUMENTS 3,671,075 A 6/1972 Bland et al.
3,695,726 A 10/1972 Krekeler
3,751,114 A 8/1973 Davis
3,785,021 A 1/1974 Norgren et al.
3,841,708 A 10/1974 Kniff et al.
D238,243 S 12/1975 Polivka
3,958,832 A 5/1976 Sigott et al.
4,006,936 A 2/1977 Crabiel
4,083,644 A 4/1978 Friedline et al.
4,140,189 A 2/1979 Garner
4,193,638 A 3/1980 Heckenhauer
4,200,159 A 4/1980 Jurgens et al.
4,299,424 A 11/1981 LeBegue et al.
4,303,136 A 12/1981 Ball
4,335,921 A 6/1982 Swisher et al.
4,337,980 A 7/1982 Krekeler et al.
4,340,325 A 7/1982 Gowanlock et al.
D270,059 S 8/1983 Wilkins
D271,497 S 11/1983 Green
4,484,644 A 11/1984 Cook et al.
4,580,930 A 4/1986 Zinner et al.
4,605,343 A 8/1986 Hibbs, Jr. et al.
4,655,508 A 4/1987 Tomlinson
4,674,802 A * 6/1987 McKenna ..... E21B 10/5673 299/112 R
4,678,237 A 7/1987 Collin et al.
4,679,858 A 7/1987 Tank
D296,107 S 6/1988 Andersson
4,765,687 A 8/1988 Parrott
4,784,023 A 11/1988 Dennis et al.
4,787,466 A 11/1988 Tomlinson et al.
4,836,178 A 6/1989 Tomlinson
4,842,337 A 6/1989 Southern
4,850,649 A 7/1989 Beach et al.
4,880,278 A 11/1989 Tomlinson
4,902,073 A 2/1990 Tomlinson et al.
D307,279 S 4/1990 Vincent
4,913,125 A 4/1990 Bunting et al.
D311,747 S 10/1990 Mihic
5,007,685 A 4/1991 Beach et al.
5,060,739 A 10/1991 Griffin et al.
5,090,491 A 2/1992 Tibbitts et al.
5,161,627 A * 11/1992 Burkett ..... E21B 10/567 299/111
5,318,351 A 6/1994 Walker
5,378,050 A 1/1995 Kammerer et al.
5,417,475 A 5/1995 Graham et al.
5,431,239 A 7/1995 Tibbitts et al.
5,605,382 A 2/1997 Massa et al.
5,649,604 A 7/1997 Fuller et al.
5,690,393 A 11/1997 Massa et al.
5,722,733 A * 3/1998 Tank ..... E21C 35/19 299/108
5,873,423 A * 2/1999 Briese ..... E21C 35/183 175/430
5,881,830 A 3/1999 Cooley
5,906,245 A 5/1999 Tibbitts et al.
5,944,129 A * 8/1999 Jensen ..... E21B 10/5673 175/430
6,089,123 A 7/2000 Chow et al.
6,105,693 A * 8/2000 Ingmarsson ..... E21B 10/36 175/420.2
6,213,931 B1 4/2001 Twardowski et al.
6,283,844 B1 9/2001 Tank
6,485,104 B1 11/2002 Keller et al.
6,779,850 B1 8/2004 Schibeci et al.
7,108,212 B2 9/2006 Latham
D558,802 S 1/2008 Nicholas
D616,003 S 5/2010 Ueda et al.
7,866,418 B2 1/2011 Bertagnolli et al.
7,998,573 B2 8/2011 Qian et al.
8,034,136 B2 10/2011 Sani
8,047,260 B2 11/2011 Uno et al.
8,079,785 B2 12/2011 Nicholas
8,236,074 B1 8/2012 Bertagnolli et al.
D666,640 S 9/2012 Cox et al.
8,567,533 B2 10/2013 Myers et al.
8,672,415 B2 5/2014 Neilson et al.
8,727,044 B2 5/2014 Qian et al.
8,789,894 B2 7/2014 Claesson et al.
9,017,438 B1 4/2015 Miess et al.
9,027,675 B1 5/2015 Jones et al.
9,028,008 B1 5/2015 Bookhamer et al.
9,238,893 B2 1/2016 Latham et al.
9,272,392 B2 3/2016 Mukhopadhyay et al.
9,272,814 B2 3/2016 Carver et al.
9,303,511 B2 4/2016 George et al.
9,382,794 B2 7/2016 Latham et al.
9,434,091 B2 9/2016 Burton et al.
9,487,847 B2 11/2016 Mukhopadhyay et al.
9,593,577 B2 3/2017 Lachmann et al.
D809,031 S 1/2018 Burton
10,018,041 B2 7/2018 Wachsmann et al.
10,316,660 B2 6/2019 Burton et al.
10,323,514 B2 6/2019 Burton et al.
10,408,057 B1 9/2019 Myers et al.
10,414,069 B2 9/2019 Miess et al.
2001/0040053 A1 11/2001 Beuershausen et al.
2002/0153175 A1 10/2002 Ojanen et al.
2003/0234569 A1 12/2003 Dawood et al.
2004/0079554 A1* 4/2004 Hauptmann ..... E21B 10/36 175/398
2005/0082898 A1 4/2005 Keller et al.
2006/0033379 A1 2/2006 Frear et al.
2006/0087169 A1 4/2006 Hesse et al.
2007/0090679 A1 4/2007 Ojanen et al.
2008/0030065 A1 2/2008 Frear et al.
2008/0035383 A1 2/2008 Hall et al.
2008/0036280 A1 2/2008 Hall et al.
2008/0202819 A1 8/2008 Fader
2008/0250724 A1 10/2008 Hall et al.
2008/0309146 A1 12/2008 Hall et al.
2009/0184564 A1* 7/2009 Brady ..... E21B 10/36 175/389
2009/0256413 A1* 10/2009 Majagi ..... E21C 35/183 299/111
2010/0052406 A1 3/2010 Beach et al.
2010/0052407 A1* 3/2010 Cameron ..... B28D 1/188 299/111
2010/0141016 A1* 6/2010 Yang ..... E21C 35/18 299/101
2010/0194176 A1 8/2010 Lucek et al.
2010/0244545 A1 9/2010 Hall et al.
2010/0326741 A1 12/2010 Patel
2011/0132667 A1 6/2011 Smallman et al.
2011/0148178 A1 6/2011 Lehnert et al.
2011/0233987 A1 9/2011 Maushart et al.
2011/0266070 A1 11/2011 Scott et al.
2012/0043138 A1 2/2012 Myers et al.
2012/0138370 A1 6/2012 Mukhopadhyay
2012/0160573 A1 6/2012 Myers et al.
2012/0175939 A1 7/2012 O'Neill et al.
2012/0274123 A1 11/2012 Ball
2012/0279786 A1 11/2012 Cox
2013/0052481 A1 2/2013 Konyashin
2013/0092451 A1 4/2013 Mukhopadhyay et al.
2013/0092452 A1 4/2013 Mukhopadhyay et al.
2013/0322975 A1 12/2013 Tan et al.
2013/0341999 A1 12/2013 Hall et al.
2014/0110991 A1 4/2014 Sollami
2014/0175853 A1 6/2014 Warren
2014/0225418 A1 8/2014 Lachmann et al.
2014/0240634 A1 8/2014 Matsuzaki
2014/0339879 A1 11/2014 Burton et al.
2014/0339883 A1 11/2014 Burton et al.

(56) References Cited

U.S. PATENT DOCUMENTS

| | | | |
|---|---|---|---|
| 2014/0368022 | A1 | 12/2014 | Torres Delgado et al. |
| 2015/0035342 | A1 | 2/2015 | Jonker et al. |
| 2015/0114727 | A1 | 4/2015 | Heuser |
| 2015/0176408 | A1 | 6/2015 | Latham |
| 2015/0176409 | A1 | 6/2015 | Latham |
| 2015/0240635 | A1 | 8/2015 | Lachmann et al. |
| 2015/0314483 | A1 | 11/2015 | Miess et al. |
| 2016/0102550 | A1 | 4/2016 | Swope et al. |
| 2016/0273356 | A1 | 9/2016 | Ojanen et al. |
| 2016/0332269 | A1 | 11/2016 | Provins et al. |

FOREIGN PATENT DOCUMENTS

| | | | |
|---|---|---|---|
| CN | 202073564 | U | 12/2011 |
| CN | 203081445 | U | 7/2013 |
| FR | 2605676 | A1 * | 4/1988 |
| GB | 1481278 | A | 7/1977 |
| GB | 2170843 | A | 8/1986 |
| GB | 2177144 | A | 1/1987 |
| GB | 2193740 | A | 2/1988 |
| WO | 2010083015 | A1 | 7/2010 |
| WO | 2012130870 | A1 | 10/2012 |
| WO | 2016071001 | A1 | 5/2016 |

OTHER PUBLICATIONS

Issue Notification for U.S. Appl. No. 16/406,673 dated May 5, 2021.
Issue Notification for U.S. Appl. No. 16/527,620 dated May 12, 2021.
Supplemental Notice of Allowance for U.S. Appl. No. 16/406,673 dated Apr. 27, 2021.
Supplemental Notice of Allowance for U.S. Appl. No. 16/527,620 dated May 7, 2021.
Advisory Action for U.S. Appl. No. 14/266,437 dated Mar. 24, 2017.
Advisory Action for U.S. Appl. No. 14/275,574 dated Mar. 9, 2017.
Advisory Action for U.S. Appl. No. 14/811,699 dated Oct. 22, 2018.
Advisory Action for U.S. Appl. No. 15/266,355 dated Oct. 11, 2018.
Advisory Action for U.S. Appl. No. 16/406,673 dated Mar. 6, 2020.
Advisory Action for U.S. Appl. No. 16/526,387 dated Aug. 10, 2020.
Advisory Action for U.S. Appl. No. 16/527,620 dated Jun. 4, 2020.
Final Office Action for U.S. Appl. No. 14/266,437 dated Dec. 12, 2016.
Final Office Action for U.S. Appl. No. 14/266,437 dated Nov. 15, 2017.
Final Office Action for U.S. Appl. No. 14/266,437 dated Sep. 18, 2018.
Final Office Action for U.S. Appl. No. 14/273,360 dated Mar. 7, 2016.
Final Office Action for U.S. Appl. No. 14/275,574 dated Nov. 29, 2016.
Final Office Action for U.S. Appl. No. 14/811,699 dated Jul. 10, 2018.
Final Office Action for U.S. Appl. No. 15/238,486 dated Feb. 26, 2018.
Final Office Action for U.S. Appl. No. 15/266,355 dated Jul. 25, 2018.
Final Office Action for U.S. Appl. No. 15/266,355 dated May 9, 2019.
Final Office Action for U.S. Appl. No. 16/406,673 dated Dec. 26, 2019.
Final Office Action for U.S. Appl. No. 16/526,387 dated Apr. 22, 2020.
Final Office Action for U.S. Appl. No. 16/527,620 dated Mar. 12, 2020.
International Search Report and Written Opinion from International Application No. PCT/US2014/037381 dated Oct. 30, 2014.
International Search Report and Written Opinion from International Application No. PCT/US2014/037708 dated Oct. 30, 2014.
International Search Report and Written Opinion from International Application No. PCT/US2015/027830 dated Jul. 14, 2015.
Issue Notification for U.S. Appl. No. 14/266,437 dated Aug. 28, 2019.
Issue Notification for U.S. Appl. No. 14/273,360 dated Aug. 17, 2016.
Issue Notification for U.S. Appl. No. 14/275,574 dated May 29, 2019.
Issue Notification for U.S. Appl. No. 14/811,699 dated Aug. 21, 2019.
Issue Notification for U.S. Appl. No. 15/238,486 dated May 22, 2019.
Issue Notification for U.S. Appl. No. 15/266,355 dated Apr. 22, 2020.
Issue Notification for U.S. Appl. No. 29/540,584 dated Sep. 14, 2017.
Issue Notification for U.S. Appl. No. 29/540,597 dated Sep. 6, 2017.
Issue Notification for U.S. Appl. No. 29/555,279 dated Jan. 10, 2018.
Issue Notification for U.S. Appl. No. 29/555,281 dated Aug. 29, 2018.
Issue Notification for U.S. Appl. No. 29/660,512 dated Aug. 28, 2019.
Non-Final Office Action for U.S. Appl. No. 14/266,437 dated Jun. 9, 2016.
Non-Final Office Action for U.S. Appl. No. 14/266,437 dated Apr. 21, 2017.
Non-Final Office Action for U.S. Appl. No. 14/266,437 dated Jan. 8, 2019.
Non-Final Office Action for U.S. Appl. No. 14/266,437 dated Mar. 28, 2018.
Non-Final Office Action for U.S. Appl. No. 14/273,360 dated Oct. 22, 2015.
Non-Final Office Action for U.S. Appl. No. 14/275,574 dated Apr. 6, 2016.
Non-Final Office Action for U.S. Appl. No. 14/275,574 dated Apr. 7, 2017.
Non-Final Office Action for U.S. Appl. No. 14/811,699 dated Jan. 4, 2019.
Non-Final Office Action for U.S. Appl. No. 14/811,699 dated Nov. 29, 2017.
Non-Final Office Action for U.S. Appl. No. 15/238,486 dated Aug. 17, 2017.
Non-Final Office Action for U.S. Appl. No. 15/266,355 dated Jan. 8, 2018.
Non-Final Office Action for U.S. Appl. No. 15/266,355 dated Nov. 29, 2018.
Non-Final Office Action for U.S. Appl. No. 16/393,603 dated Aug. 6, 2020.
Non-Final Office Action for U.S. Appl. No. 16/406,673 dated Apr. 3, 2020.
Non-Final Office Action for U.S. Appl. No. 16/406,673 dated Jun. 27, 2019.
Non-Final Office Action for U.S. Appl. No. 16/526,387 dated Oct. 4, 2019.
Non-Final Office Action for U.S. Appl. No. 16/526,387 dated Sep. 24, 2020.
Non-Final Office Action for U.S. Appl. No. 16/527,620 dated Jun. 22, 2020.
Non-Final Office Action for U.S. Appl. No. 16/527,620 dated Oct. 2, 2019.
Non-Final Office Action for U.S. Appl. No. 29/555,279 dated Mar. 24, 2017.
Notice of Allowance for U. S. U.S. Appl. No. 14/273,360 dated May 18, 2016.
Notice of Allowance for U.S. Appl. No. 14/266,437 dated May 2, 2019.
Notice of Allowance for U.S. Appl. No. 14/275,574 dated Feb. 12, 2019.
Notice of Allowance for U.S. Appl. No. 14/275,574 dated Jan. 24, 2018.
Notice of Allowance for U.S. Appl. No. 14/275,574 dated Jun. 15, 2018.

(56) References Cited

OTHER PUBLICATIONS

Notice of Allowance for U.S. Appl. No. 14/275,574 dated Oct. 11, 2018.
Notice of Allowance for U.S. Appl. No. 14/275,574 dated Sep. 26, 2017.
Notice of Allowance for U.S. Appl. No. 14/811,699 dated May 1, 2019.
Notice of Allowance for U.S. Appl. No. 15/238,486 dated Jan. 28, 2019.
Notice of Allowance for U.S. Appl. No. 15/238,486 dated Jun. 20, 2018.
Notice of Allowance for U.S. Appl. No. 15/238,486 dated Oct. 10, 2018.
Notice of Allowance for U.S. Appl. No. 15/266,355 dated Jan. 9, 2020.
Notice of Allowance for U.S. Appl. No. 15/266,355 dated Sep. 24, 2019.
Notice of Allowance for U.S. Appl. No. 16/406,673 dated Sep. 23, 2020.
Notice of Allowance for U.S. Appl. No. 16/526,387 dated Mar. 25, 2021.
Notice of Allowance for U.S. Appl. No. 16/527,620 dated Feb. 4, 2021.
Notice of Allowance for U.S. Appl. No. 16/527,620 dated Sep. 29, 2020.
Notice of Allowance for U.S. Appl. No. 29/540,584 dated May 8, 2017.
Notice of Allowance for U.S. Appl. No. 29/540,597 dated May 8, 2017.
Notice of Allowance for U.S. Appl. No. 29/555,269 dated Apr. 6, 2017.
Notice of Allowance for U.S. Appl. No. 29/555,279 dated Aug. 31, 2017.
Notice of Allowance for U.S. Appl. No. 29/555,281 dated Apr. 12, 2017.
Notice of Allowance for U.S. Appl. No. 29/555,281 dated Jan. 4, 2018.
Notice of Allowance for U.S. Appl. No. 29/555,281 dated May 16, 2018.
Notice of Allowance for U.S. Appl. No. 29/660,512 dated Apr. 25, 2019.
Notice of Allowance for U.S. Appl. No. 16/406,673 dated Jan. 22, 2021.
Restriction Requirement for U.S. Appl. No. 14/273,360 dated Jun. 12, 2015.
Supplemental Notice of Allowance for U.S. Appl. No. 14/266,437 dated Aug. 19, 2019.
Supplemental Notice of Allowance for U.S. Appl. No. 14/273,360 dated Aug. 10, 2016.
Supplemental Notice of Allowance for U.S. Appl. No. 14/275,574 dated May 21, 2019.
Supplemental Notice of Allowance for U.S. Appl. No. 14/275,574 dated Oct. 31, 2018.
Supplemental Notice of Allowance for U.S. Appl. No. 15/238,486 dated Jun. 27, 2018.
Supplemental Notice of Allowance for U.S. Appl. No. 29/540,584 dated Sep. 7, 2017.
Supplemental Notice of Allowance for U.S. Appl. No. 29/540,597 dated Aug. 25, 2017.
Supplemental Notice of Allowance for U.S. Appl. No. 29/540,597 dated Jun. 1, 2017.
Supplemental Notice of Allowance for U.S. Appl. No. 29/555,269 dated Apr. 28, 2017.
Supplemental Notice of Allowance for U.S. Appl. No. 29/555,279 dated Jan. 2, 2018.
Supplemental Notice of Allowance for U.S. Appl. No. 29/555,281 dated Feb. 9, 2018.
Supplemental Notice of Allowance for U.S. Appl. No. 29/555,281 dated Jun. 12, 2017.
Supplemental Notice of Allowance for U.S. Appl. No. 29/555,281 dated Jun. 4, 2018.
U.S. Appl. No. 12/961,787, filed Dec. 7, 2010.
U.S. Appl. No. 13/027,954, filed Feb. 15, 2011.
U.S. Appl. No. 13/070,636, filed Mar. 24, 2011.
U.S. Appl. No. 13/100,388, filed May 4, 2011.
U.S. Appl. No. 13/275,372, filed Oct. 18, 2011.
U.S. Appl. No. 13/648,913, filed Oct. 10, 2012.
U.S. Appl. No. 13/765,027, filed Feb. 12, 2013.
U.S. Appl. No. 13/795,027, filed Mar. 12, 2013.
U.S. Appl. No. 14/266,437, filed Apr. 30, 2014.
U.S. Appl. No. 14/273,360, filed Mar. 7, 2016.
U.S. Appl. No. 14/275,574, filed May 12, 2014.
U.S. Appl. No. 14/811,699, filed Jul. 28, 2015.
U.S. Appl. No. 15/238,486, filed Aug. 16, 2016.
U.S. Appl. No. 16/406,673, filed May 8, 2019.
U.S. Appl. No. 16/527,620, filed Jul. 31, 2019.
U.S. Appl. No. 29/540,584, filed Sep. 25, 2015.
U.S. Appl. No. 29/540,597, filed Sep. 25, 2015.
U.S. Appl. No. 29/555,269, filed Feb. 19, 2016.
U.S. Appl. No. 29/555,279, filed Feb. 19, 2016.
U.S. Appl. No. 29/555,281, filed Feb. 19, 2016.
U.S. Appl. No. 61/824,007, filed May 16, 2013.
U.S. Appl. No. 61/824,022, filed May 16, 2013.
U.S. Appl. No. 62/030,525, filed Jul. 29, 2014.
U.S. Appl. No. 62/232,732, filed Sep. 25, 2015.
Roepke, et al., "Drag Bit Cutting Characteristics Using Sintered Diamond Inserts", Report of Investigations 8802, Bureau of Mines Report of Investigations, 1983, 35 pages.

* cited by examiner

SHEAR CUTTER PICK MILLING SYSTEM

CROSS-REFERENCE TO RELATED APPLICATIONS

This application is a continuation of U.S. patent application Ser. No. 16/406,673 filed 8 May 2019, which is a continuation of U.S. patent application Ser. No. 14/275,574 filed 12 May 2014, which claims priority to U.S. Provisional Application No. 61/824,022 filed on 16 May 2013, the entire contents of each of which are incorporated herein by this reference.

BACKGROUND

Milling and grinding machines are commonly used in the asphalt and pavement industries. In many cases, maintaining paved surfaces with grinding and milling machines may significantly increase the life of the roadway. For example, a road surface that has developed high points is at greater risk for failure because vehicles and heavy trucks that hit the high point may bounce on the road. The impact force of the bouncing overtime may damage to the road surface.

Additionally, portions of the road surface may occasionally need to be ground down to remove road markings, such as centerlines or crosswalk markings. For instance, when roads are expanded or otherwise changed, the road markings also may need to be changed. In any event, at least a portion of material forming a road surface may be removed for any number of reasons.

Typically, removal of material forming the road surface wears the tools and equipment used therefor. Moreover, tool and equipment wear may reduce useful life thereof. Therefore, manufacturers and users continue to seek improved road-removal systems and apparatuses to extend the useful life of such system and apparatuses.

SUMMARY

Embodiments of the invention relate to methods and apparatus for using polycrystalline compacts ("PDC") to mill a road surface. In particular, a PDC can be positioned and configured such that a substantially planar working surface of the PDC engages the road surface. Engaging the road surface with the substantially planar working surface may shear and/or cut through the road surface. Such PDCs may perform better in a shearing function than in a crushing function.

At least one embodiment is directed to a system for removing a road material. In particular, the system includes a milling drum rotatable about a rotation axis, and a plurality of picks mounted on the milling drum. Each of the plurality of picks includes a pick body and a polycrystalline diamond compact ("PDC") attached to the pick body. The PDC has a substantially planar working surface and a nonlinear cutting edge at least partially surrounding the working surface.

Additional or alternative embodiments involve a method of removing road material. The method includes advancing a plurality of picks toward road material, each of the plurality of picks including a polycrystalline diamond compact ("PDC") that forms a substantially planar working surface and a nonlinear cutting edge at least partially surrounding the working surface. The method also includes advancing the nonlinear cutting edges and the substantially planar working surfaces of the picks into the road material, thereby failing at least some of the road material while having the substantially planar working surfaces oriented at one or more of a positive rake angle or negative rake angle.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments of the invention relate to road-removal devices, systems, and methods. In particular, embodiments include road-removal devices and systems that incorporate superhard material, such as PDC. For instance, the PDCs may include one or more cutting edges that may be sized and configured to engage the road surface during road-removal operations. Moreover, engaging the road material with the cutting edge(s) may cut, shear, grind, or otherwise fail the road material and may facilitate removal thereof. In some embodiments, failing the road material may produce a relatively smooth or flat road surface, which may increase the useful life of the road.

Figure 1A:
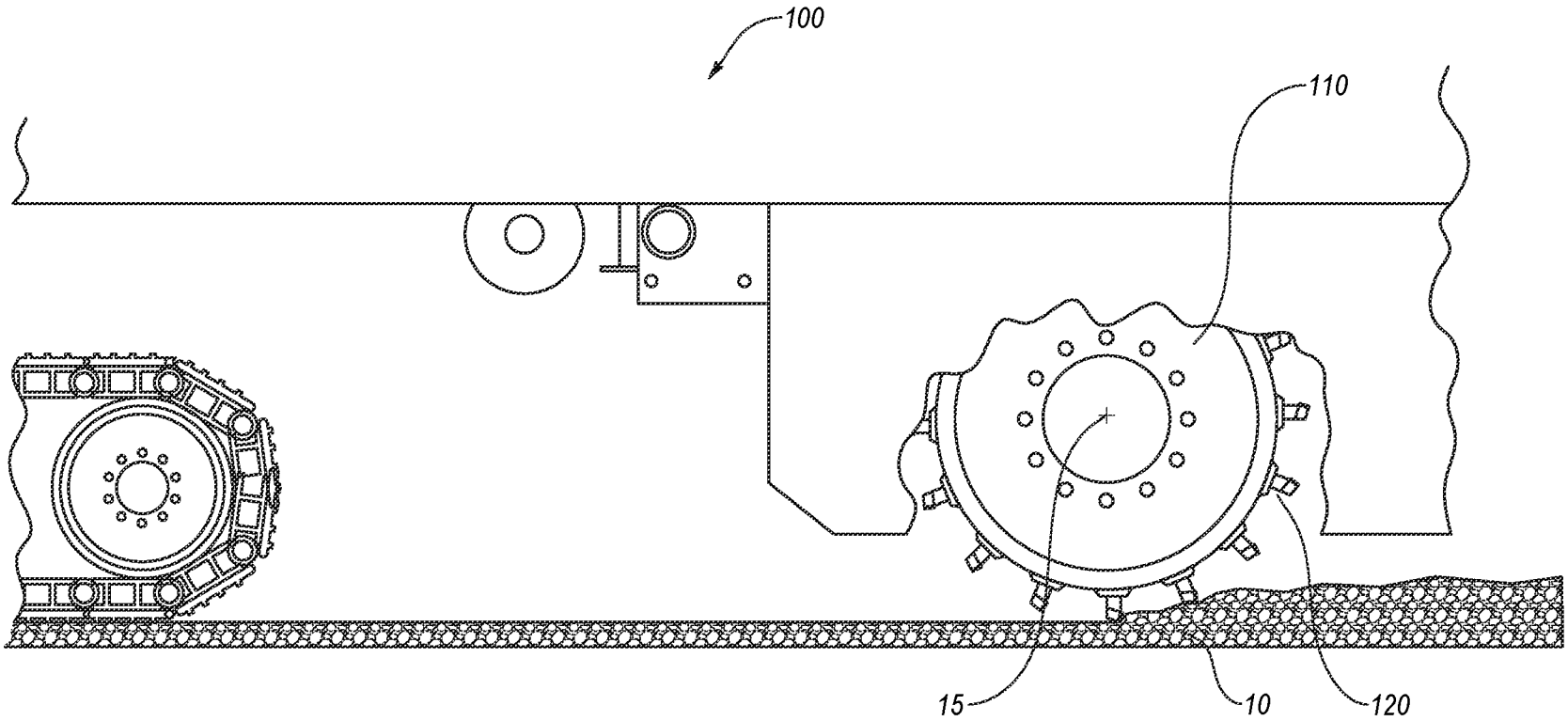
FIG. 1A is a schematic illustration of a road-removal system according to an embodiment.
Figure 1B:
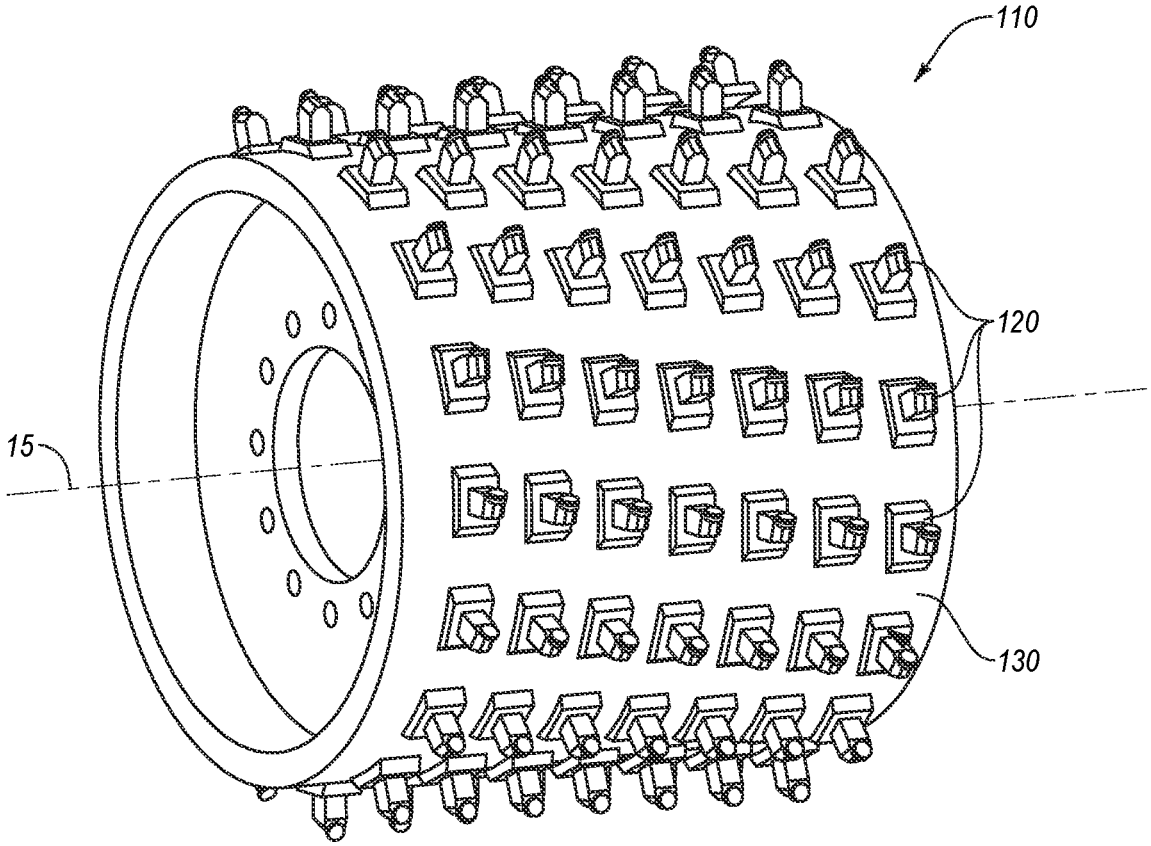
FIG. 1B is an isometric view of a milling drum according to an embodiment.
Figure 1C:
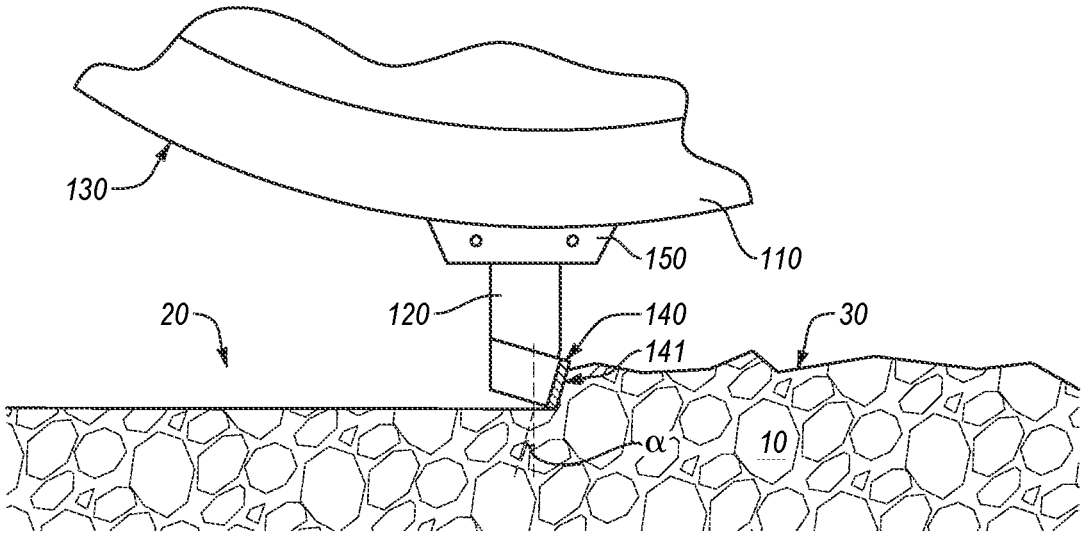
FIG. 1C is a side view of the milling drum of FIG. 1B having at least one pick engaged with road material according to an embodiment.

FIGS. 1A-1C illustrate an embodiment of a road-removal system 100. FIG. 1A illustrates the road-removal system 100 during operation thereof, failing and/or removing road material 10 according to an embodiment. For example, the road-removal system 100 includes a milling drum 110 that may rotate about a rotation axis 15 together with picks 120, which may be attached to and protrude from the milling drum 110. In some embodiments, the milling drum 110 may be operably coupled to a motor that may rotate the milling drum 110 and the picks 120 about the rotation axis 15. During rotation of the milling drum 110, the picks 120 may engage and fail the road material 10.

Generally, any number of picks 120 may be attached to the milling drum 110. Moreover, particular sizes, shapes, and configurations of picks may vary from one embodiment to the next. In some instances, a pick configuration that may be used for removing an entire thickness or all of the road material 10 may be different from another pick configuration that may be used to smooth the road surface and/or remove imperfections therefrom.

In some instances, bumpy and uneven road surfaces may lead to excessive wear and shorten the life of the road surface. In one or more embodiments, the picks 120 may be configured to remove at least a portion of the road material 10 and recreate or renew the road surface. In particular, in an embodiment, the picks 120 may grind, cut, or otherwise fail the road material 10 as the milling drum 110 rotates, and the failed road material may be subsequently removed (e.g., by the road-removal system 100). In some embodiments, the picks 120 do not remove all of the road material but only remove some road material, such as a limited or predetermined thicknesses thereof (e.g., measured from the road surface), which may remove abnormalities, bulges, etc., from the road surface.

The road-removal system 100 may also be used for adding and removing road markings, such as epoxy or paint lines. Road markings may include highly visible and wear-resistant material. In some cases, the road marking material may be difficult to remove from the road surface without damaging or destroying the road surface. Furthermore, some instances may require removal of existing road markings and placement of new road markings (e.g., a construction project may temporarily or permanently reroute traffic and may require new lane markings).

Insufficient or incomplete removal of road markings, however, may lead to dangerous road conditions. For example, a driver may be unable to distinguish between the former lanes and the new lanes. In some cases, removing road markings may involve removing at least some of the road material 10 together with the markings that are affixed thereto. In any event, in an embodiment, the picks 120 may be configured to remove paint and/or epoxy from the road material 10. In some instances, a relatively narrow milling drum with a relatively narrow or tight pick distribution may be used to remove road markings, such as paint and epoxy, which may localize the removal of the road material 10 to the area that approximates the size and shape of the removed road markings. In other words, in an embodiment, the picks 120 may be set to remove the road marking and a thin layer of road material 10 below the road marking such that no trace of the marking remains.

Similarly, in an embodiment, the road-removal system 100 may be used to inlay paint or epoxy within the road material 10. Inlaying paint or epoxy within the road surface can provide protection to the paint of epoxy. Thus, similar to the one or more embodiments described above, the road-removal system 100 may be used to create narrow strips or recesses within the road material 10 (e.g., at a predetermined depth from the road surface). In particular, for instance, created recesses may be sized and shaped to approximately the desired size and shape of the road markings (e.g., epoxy, paint, etc.). In an embodiment, the picks 120 may be operated dry, such as without or with limited amount of fluid or coolant provided to the picks 120 during the removal of the road material 10. Absence of fluid on the road material 10 may facilitate application of paint, epoxy, or other road marking material to the road surface (e.g., reducing time between removal of road material 10 and application of road markings).

Further, in an embodiment, the road-removal system 100 may be used to create water flow channels. Improper or ineffective water drainage on road surfaces 10 may create safety problems and may lead to road damage. For instance, if standing water is left on the road surface, hydroplaning and/or ice may result, which may cause accidents. Additionally, the expansion of freezing water on the road material 10 may cause the road material 10 to buckle and/or crack. Accordingly, in an embodiment, the road-removal system 100 may be used to form water flow channels in the road material 10.

FIG. 1B illustrates an isometric view of the milling drum 110. In an embodiment, the milling drum 110 may rotate about the rotation axis 15 together with a plurality of picks 120 mounted or otherwise secured to the milling drum 110 and projecting from a surface 130 thereof. While the milling drum 110 has a particular density and configuration of the pick 120 placement, a variety of different pick configurations and pick spacing may be used. For example, if the milling drum 110 is being configured to smooth or flatten the road material 10, it may be desirable to use a pick configuration that exhibits a high density and a high uniformity of pick placement and a type of the pick 120 that does not deeply penetrate the road material 10. In an embodiment, the milling drum 110 may be suitable for use in machining, grinding, or removing imperfections from a road material 10.

The particular type of pick as well as mounting position and/or orientation thereof on the milling drum 110 may affect removal of road material 10. FIG. 1C illustrates one example of the milling drum 110, which includes multiple picks 120 mounted about an outer surface 130 of the milling drum 110. In some embodiments, the picks 120 may be mounted in one or more holders or mounting bases 150, which may facilitate attachment of the picks 120 to the milling drum 110 as well as removal and replacement of the picks.

In some instances, the mounting bases 150 may be larger than pick bodies of the picks 120, which may limit the density of picks 120 in a single row as well as the number of rows on the milling drum and/or combined length of cutting edges (i.e., the sum of lengths of all cutting edges), by limiting minimum distance between adjacent picks 120. Hence, in an embodiment, the milling drum may produce a reconditioned surface 20 that includes multiple grooves or striations formed by the picks 120. Alternatively, however, the milling drum may produce a substantially uniform or flat surface, without groove or with minimal grooves. For example, the picks 120 may be offset one from another in a manner that provides overlap of cutting edges along a width of the milling drum in a manner that produces a flat surface.

In an embodiment, the pick 120 includes a PDC 140 affixed to an end region or portion of a pick body, as described below in more detail. Moreover, in an embodiment, the PDC 140 includes a cutting edge (described below in more detail), which extends between a substantially planar working surface 141 and at least one side surface. For example, the cutting edge may be adapted to cut, grind, scrape, or otherwise fail the road material 10. Additionally or alternatively, in some instances, the cutting edge or face of the pick 120 may have a conical or rounded peripheral shape, which may create a grooved or uneven surface (e.g., as compared to a flat and smooth reconditioned road surface 20, which may be formed by the picks 120 with planar working surfaces).

In some instances, the pick 120 may remove an upper layer or portion of the road material 10. Specifically, in an embodiment, in contrast to using an impact and crushing force to break apart the road surface, the cutting edge of the pick 120 may scrape, shear, cut, or otherwise fail the road material 10 (e.g., to a predetermined depth). In some instances, cutting through the road material 10 (e.g., through upper portion of the road material 10) may provide substantially more control over the amount of road material 10 that is removed from the road surface than removing road material 10 by crushing and impacting the road material 10.

In some embodiments, at least a portion of the cutting edge of the pick 120 may be substantially straight or linear. Accordingly, in an embodiment, the road-removal system 100 that includes multiple picks 120 may produce a substantially flat or planar reconditioned road surface 20. Also, in some embodiments, the unfinished road surface 30 that is in front of the pick 120 may be rough and uneven. In an embodiment, as the milling drum 110 rotates and causes the pick 120 to engage the unfinished road surface 30, the cutting edge of the pick 120 grinds and/or scrapes the unfinished road surface 30 and road material 10, thereby removing imperfections and undesirable artifacts from the unfinished road surface 30 and producing the reconditioned road surface 20.

Additionally, the substantially planar working surface 141 of the PDC 140 may form a suitable or an effective back rake angle $\alpha$, as described in further detail below. In particular, the back rake angle $\alpha$ may be formed between the working surface 141 and a vertical reference axis (e.g., an axis perpendicular to a tangent line at the lowermost point of contact between the pick 120 and the road material 10). In one example, the vertical reference axis may be approximately perpendicular to the reconditioned road surface 20. Accordingly, in some embodiments, the working surface 141 of the PDC 140 may be oriented at a non-perpendicular angle relative to the reconditioned road surface 20, when the cutting edge of the PDC 140 is at the lowermost position relative to the surface of the road material 10. In other words, the working surface may be oriented at a non-perpendicular angle relative to an imaginary line tangent to the rotational path of the cutting edge of the pick.

The back rake angle $\alpha$ may aid in evacuating or clearing cuttings or failed road material during the material removal process. In some embodiments, as shown in FIG. 1C, the back rake angle $\alpha$ may be a negative back rake angle (i.e., forming an obtuse angle with the reconditioned road surface 20 when the cutting edge of the PDC 140 is at the lowest rotational position). Alternatively, as described below in more detail, the back rake angle may be a positive rake angle. Moreover, the milling drum 110 may include any number of picks that include PDC oriented in a manner that forms negative and/or positive back rake angles during operation of the milling drum 110.

Additionally, under some operating conditions, the road-removal system 100 may remove road material to a specific or predetermined depth. In some cases, such as with especially thick or multiple layers of the road material 10, the system may remove the road material 10 over multiple passes or in a single pass having a sufficiently deep cut. In contrast, a thin layer of road material 10 may be removed with a shallow cut. In any event, a variety of cutting depths can be set without interfering with the shearing configuration of the PDCs.

The depth of placement or positioning of the milling drum 110, which may determine the depth to which the pick 120 engages the road material 10, may be controlled by any number of suitable methods and apparatuses. Also, in some embodiments, the picks 120 and the road-removal system may be configured to remove less than approximately 60 cm of road surface during the grinding operation. Furthermore, in an embodiment, the picks 120 and the road-removal system may be configured to remove less than approximately 30 cm of road surface, less than approximately 20 cm of road surface, less than approximately 10 cm of road surface, less than approximately 1 cm, or approximately 4 mm to approximately 6 mm of road surface.

In some applications, removing an excessive amount of road material may lead to a significant reduction in the life of the road. Hence, it should be appreciated that the picks may have any number of suitable sizes, shapes, or configurations (e.g., PDCs and pick bodies may have various configurations), which may vary from one embodiment to the next and may affect removal of the road material 10. In any case, however, a pick may include polycrystalline diamond that includes a cutting edge configured to grind, mill, or otherwise fail a layer or portion of the road material 10 that may be subsequently removed.

Figure 2C:
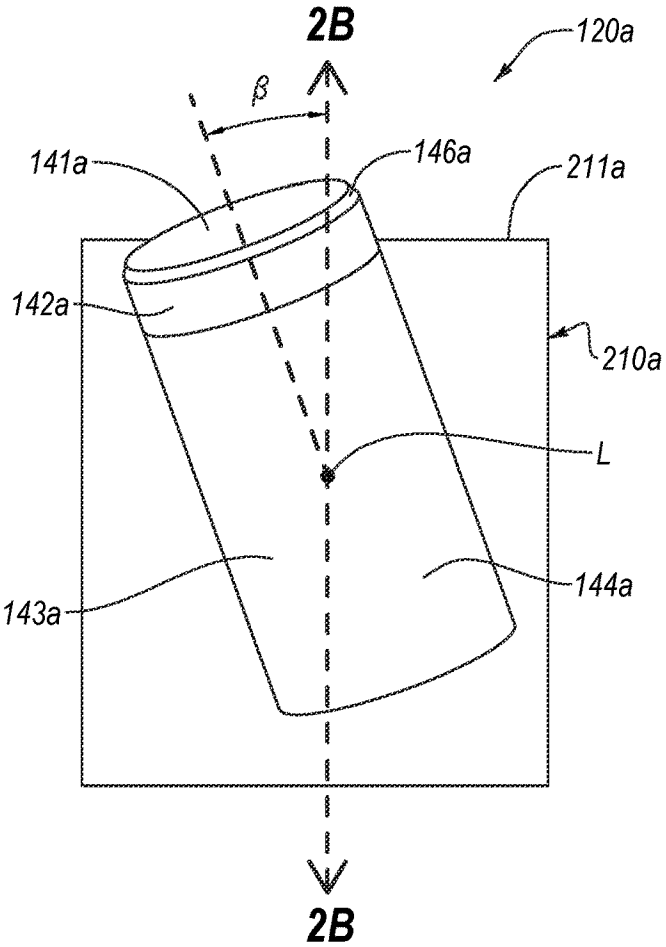
FIG. 2C is a top view of a pick according to an embodiment.
Figure 2B:
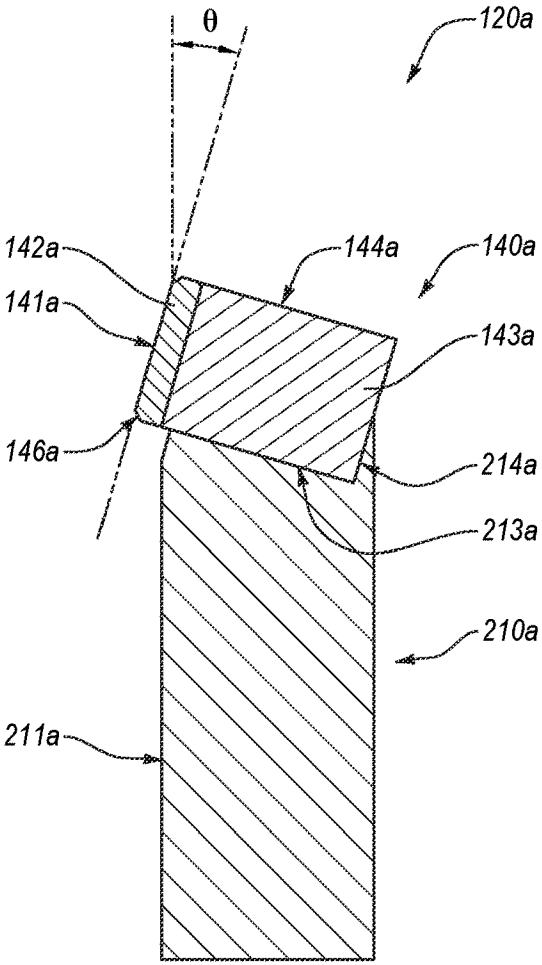
FIG. 2B is a cross-sectional view of the pick of FIG. 2A.
Figure 2A:
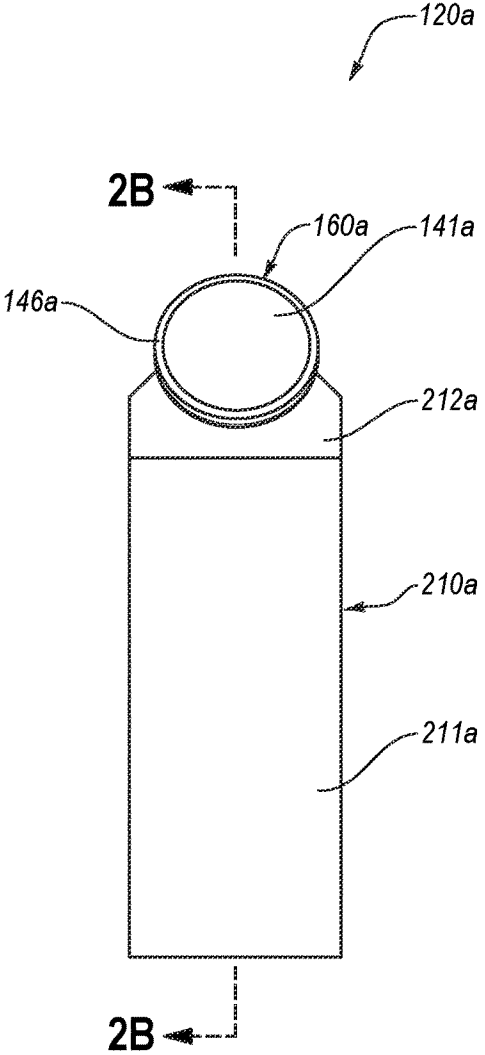
FIG. 2A is a front view of a pick according to an embodiment.

FIGS. 2A and 2B illustrate a pick 120*a* according to an embodiment. The pick 120*a* includes a PDC 140*a* mounted to a pick body 210*a*. Except as otherwise described herein, the pick 120*a* and its materials, elements, or components may be similar to or the same as the pick 120 (FIGS. 1A-1C). In at least one embodiment, the pick 120*a* may include a substantially planar working surface 141*a*, which may be configured to engage and fail the road material. For instance, the PDC 140*a* of the pick 120*a* may include a cutting edge 160*a* that may facilitate penetration of the PDC 140*a* into the road material. Moreover, at least a portion of or the entire working surface 141*a* may include polycrystalline diamond.

In one or more embodiments, the PDC 140*a* may have a generally cylindrical shape (i.e., an approximately circular cross-sectional shape). Moreover, the working surface 141*a* may have an approximately circular shape. As such, in an embodiment, the cutting edge 160*a* may be substantially nonlinear. For instance, the cutting edge 160*a* may be circular or semicircular, rounded, etc. Hence, in an embodiment, the cutting edge 160*a* may at least partially surround the working surface 141*a*. Alternatively, the PDC 140*a* and/or the working surface 141*a* may have any number of suitable shapes, such as square, hexagonal (or other multi-faceted), triangular, etc. In any event, in an embodiment, the working surface 141*a* may be substantially flat or planar.

In some instances, the PDC 140*a* also may include chamfers, filets, or similar features that may smooth or round otherwise sharp edges of the PDC 140*a*. For example, the PDC 140*a* may include one or more chamfers that extend between the working surface 141*a* and one or more sides thereof, such as chamfer 146*a*. In addition, the chamfer 146*a* may extend about at least a portion of the perimeter of the working surface 141*a* (i.e., the chamfer 146*a* may at least partially surround the working surface 141*a*). As such, for example, the chamfer 146*a* may have a circular cross-sectional shape, which may be similar to or the same as the shape of the working surface 141*a*. Under some operating conditions, rounded or chamfered edges may improve crack and/or fracture resistance of the PDC 140*a* (as compared with a PDC having sharp corners and/or edges that engage road material). For instance, fillets or chamfers may reduce or minimize chipping, cracking, etc., of PDC 140*a* during operation.

Thus, for example, a portion of the chamfer 146*a* may form or define the cutting edge 160*a*. For example, the cutting edge 146*a* may be formed at the interface (or sharp corner) between the working surface 141*a* and the chamfer 146*a*. Additionally or alternatively, the cutting edge 160*a* may be formed at the interface between the chamfer 146*a* and a peripheral surface of the PDC 140*a*. Also, in some instances, the surface of the chamfer 146*a* may engage and fail road material and/or may facilitate entry of the PDC 140*a* into the road material.

In an embodiment, the PDC 140*a* may include a polycrystalline diamond ("PCD") table 142*a* bonded to a substrate 143*a*. For example, PCD table 142*a* may include the working surface 141*a*, which may be substantially flat. The substrate 143*a* may comprise cobalt-cemented tungsten carbide or another suitable superhard material, such as another type of cemented carbide material.

In some embodiments, the working surface 141*a* may have or form a negative back rake angle θ during operation of the pick 120*a*. For example, the back rake angle θ may be in one or more of the following ranges: between approximately 0 and approximately 45 degrees; between approximately 0 and approximately 30 degrees; between approximately 0 and approximately 25 degrees, between approximately 0 and approximately 20 degrees; between approximately 0 and approximately 15 degrees; between approximately 0 and approximately 10 degrees; or between approximately 0 and approximately 5 degrees. Additionally, the back rake angle θ may be an angle of approximately 6 to approximately 14 degrees, approximately 8 to approximately 12 degrees, or approximately 10 degrees. In an embodiment, each of the recited back rank angles may be a positive back rake angle. In some instances, as noted above, the back rake may aid in evacuating cuttings during a grinding, milling, or other removal of the road material.

FIG. 2C is a top view of a pick 120*a* according to an embodiment. Plane 2B-2B extends through the longitudinal axis L of the pick 120*a*, as shown in the front and cross-sectional views of the pick 120*a* in FIGS. 2A and 2B. In an embodiment, the working surface 141*a* of the PDC 140*a* may form or produce no side rake (i.e., side rake of about 0 degrees). Alternatively, the pick 120*a* may have one or more working surfaces 141*a*, which may form at least one side rake angle β. For example, the working surfaces angled to one side relative to a longitudinal axis of the pick body 210*a*. The side rake angle(s) β may be in one or more ranges described above in connection with the back rake angle θ. In some instances, one or more of the side rake angles β may be different from the back rake angle θ.

As noted above, in some embodiments, the PDC 140*a* may include a chamfer 146*a* that may at least partially or entirely surround the working surface 141*a*. The chamfer 146*a* may also engage and fail the target road material (e.g., in a similar manner as the working surface 141*a* engages the target material). Furthermore, a suitable large chamfer 146*a* may provide a side rake on opposing sides of the PDC 140*a*. Accordingly, in at least one embodiment, the PDC 140*a* may include one or more portions that may have side rake angles. Also, as the chamfer 146*a* extends about the working surface 141*a*, angular orientation of the surface formed by the chamfer 146*a* may vary in a manner that provides varying back rake and/or side rake angles.

Generally, the back rake angle and/or side rake angle(s) may be produced in any number of suitable ways. In some embodiments, the PCD table 142*a* of the PDC 140*a* may have an approximately uniform thickness and/or the working surface 141*a* of the PDC 140*a* may be approximately parallel to a bottom surface of the substrate 143*a*. Hence, the PDC 140*a* may be oriented relative to the pick body 210*a* and/or relative to the milling drum in a manner that forms desired or suitable side and/or back rake angles. Additionally or alternatively, the mounting side of the PDC 140*a* may be angled relative to the working surface of the PDC (e.g., the PCD table may have non-uniform or inconsistent thickness and/or the substrate may have a non-uniform thickness), which may form desired or suitable side and/or back rake angles. Furthermore, in an embodiment, the pick may be oriented relative to the milling drum in a manner that forms desired or suitable side and/or back rake angles. Also, in at least one embodiment, the side rake angle and/or back rake angle may be adjustable. For example, an attachment of the PDC may provide for angular adjustment.

In an embodiment, the substrate 143*a* may be positioned in a pocket or recess in the pick body 210*a*, such as in a recess 213*a*, and brazed or press-fit within the recess. In an embodiment, the recess 213*a* may at least partially secure the PDC 140*a* to the pick body 210*a*. Furthermore, the recess 213*a* may locate the PDC 140*a* relative to one or more surfaces and/or features of the pick body 210*a*. For instance, the recess 213*a* may orient the working surface 141*a* relative to a front surface 211*a* of the pick body 210*a*.

In an embodiment, a portion of the pick body 210*a* may be oriented substantially parallel to the working surface 141*a*. For example, the pick body 210*a* may include an angled portion 212*a*, which may be angled relative to the front surface 211*a* and/or may be approximately parallel to the working surface 141*a*. Hence, at least a portion of the pick body 210*a* (e.g., the angled portion 212*a*) may channel failed road material away from the pick 120*a*, which may reduce wear of the pick body 210*a* and/or of the PDC 140*a*.

Generally, the PDC 140*a* may be attached to the pick body 210*a* by brazing, fastening, press fitting, or other suitable methods or mechanisms, or combinations thereof. Moreover, the recess 213*a* also may facilitate attachment of the PDC 140*a* to the pick body 210*a* and/or may at least partially restrain the PDC 140*a* from movement relative to the pick body 210*a* during operation of the pick 120*a*. For example, the recess 213*a* may terminate at a bottom surface 214*a*, which may prevent or restrict movement of the PDC 140*a* away from the front surface 211*a* of the pick body 210*a*. Under some operating conditions, as the working surface 141*a* engages the target road material, the PDC 140*a* may experience a force (e.g., directed tangentially relative to the rotation of the pick 120*a* and/or away from the front surface of the pick), which may press the PDC 140*a* against the bottom surface 214*a* of the recess 213*a*; the bottom surface 214*a*, however, may impede movement of or restrain the PDC 140*a*.

In some embodiments, at least a portion of the PDC 140*a* (in addition to the working surface 141*a*) may be exposed outside of the pick body 210*a*. For instance, a top portion

144*a* of the substrate 140*a* may protrude out of the recess 213*a* and above the pick body 210*a*. As such, in some instances, at least a portion of the substrate 143*a* (e.g., the top portion 144*a*) may contact or engage and/or fail the road material during operation of the pick 120*a*.

In an embodiment, the top portion 144*a* of the PDC 140*a* may form a relief angle relative to the road material and/or relative to the reconditioned surface thereon. For instance, the relief angle formed by the top portion 144*a* relative to the reconditioned surface may be the same as the back rake angle θ. Furthermore, in an embodiment, when the pick 120*a* is operating, the lowermost point or points of the pick 120*a* (which contact and fail the road material) may be located on the PCD table 142*a*. Hence, for example, depending on the depth of cut or penetration of the pick 120*a* into the road material, the relief angle may provide clearance between the top surface 144*a* of substrate 143*a* and the road material. In other words, in some embodiments, the relief angle may prevent or limit contact between the substrate 143*a* and road material, thereby extending useful life of the PDC 140*a* and of the pick 120*a*.

Figure 3:
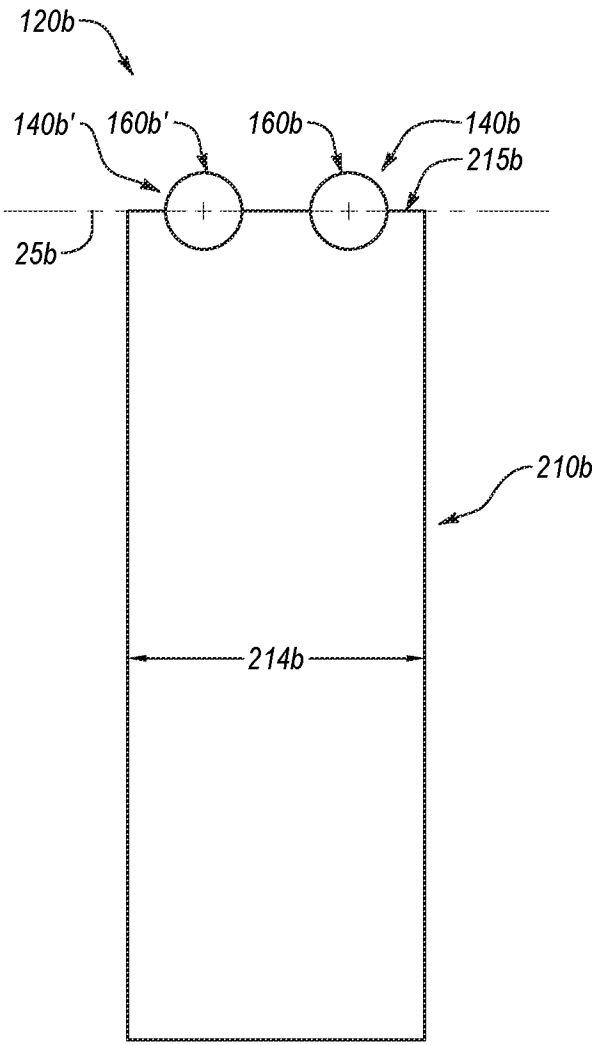
FIG. 3 is a front view of a pick according to another embodiment.

In some embodiments, the pick may include a single PDC attached to the pick body. It should be appreciated, however, that this disclosure is not so limited. For example, the pick may include multiple PDCs. FIG. 3 illustrates a pick 120*b* according to an embodiment. In particular, for instance, the pick 120*b* includes two PDCs 140*b*, 140*b*' attached to a pick body 210*b*. Except as otherwise described herein, the pick 120*b* and its materials, elements, or components may be similar to or the same as any of the picks 120, 120*a* (FIGS. 1A-2B) and their respective materials, elements, and components. For instance, the PDCs 140*b*, 140*b*' may be similar to or the same as the PDC 140*a* (FIGS. 2A-2B).

In an embodiment, the PDCs 140*b*, 140*b*' may have substantially the same size and/or shape as each other. In other words, the PDCs 140*b*, 140*b*' may be interchangeable. Moreover, in an embodiment, one or more of the PDCs 140*b*, 140*b*' may be smaller than a width 214*b* of the pick body 210*b*. For example, collective width of the PDCs 140*b*, 140*b*' may be smaller than the width 214*b* of the pick body 210*b*. Accordingly, in an embodiment, the pick body 210*b* may include one or more portions of a top surface 215*b* that are exposed or not covered by the PDCs 140*b*, 140*b*'.

In some embodiments, when the pick 120*b* is in operation, the lowermost portions of the pick 120*b* may be formed by the PDCs 140*b*, 140*b*' (e.g., the portions of the PDCs 140*b*, 140*b*' farthest from the pick body 210*b*). Under some operating conditions, cutting points or edges 160*b*, 160*b*' of the PDCs 140*b*, 140*b*' may be configured to engage the road material at approximately the same depth or depths as each other. In an embodiment, centers of the PDCs 140*b*, 140*b*' may be generally aligned along a reference line 25*b*. For instance, the reference line 25*b* may be approximately parallel to the rotation axis of the milling drum and/or parallel to the reconditioned surface.

In an embodiment, the pick body 210*b* may have a substantially flat top surface 215*b*. Hence, in some instances, the PDCs 140*b*, 140*b*' may protrude above the top surface 215*b*. For example, a half of each of the PDCs 140*b*, 140*b*' may protrude above the top surface 215*b* (e.g., the top surface 215*b* of the pick body 210*b* may be parallel to and aligned with the reference line 25*b*).

Figure 4:
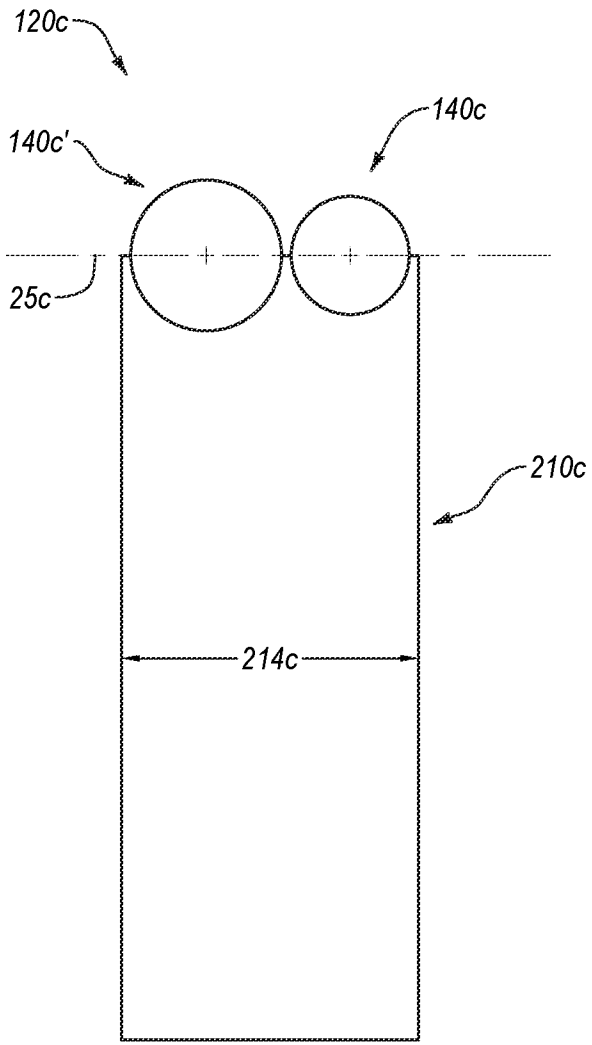
FIG. 4 is a front view of a pick according to yet another embodiment.

Additionally or alternatively, in at least one embodiment, the pick may include multiple PDCs at least two of which may have different sizes and/or shapes from each other. For example, FIG. 4 illustrates a pick 120*c* that includes PDCs 140*c*, 140*c*' attached to a pick body 210*c*. Except as otherwise described herein, the pick 120*c* and its materials, elements, or components may be similar to or the same as any of the picks 120, 120*a*, 120*b* (FIGS. 1A-3) and their respective materials, elements, and components. For example, the PDCs 140*c*, 140*c*' and/or pick body 210*c* may be similar to the PDCs 140*b*, 140*b*' and pick body 210*b* (FIG. 3), respectively.

In an embodiment, the PDC 140*c*' may be bigger than the PDC 140*c*. Accordingly, in at least some instances, the PDC 140*c*' may engage the road material at a greater depth than the PDC 140*c*. For example, the PDCs 140*c*, 140*c*' may lie along a reference line 25*c* (i.e., centers of the PDCs 140*c*, 140*c*' may lie on the reference line 25*c*), which may have an approximately parallel orientation relative to the rotation axis of the milling drum and/or relative to the reconditioned surface. Hence, the PDC 140*c*' may engage and/or fail the road material at a greater depth than the PDC 140*c*.

In an embodiment, the milling drum may include multiple picks, such as the pick 120*c*, which may be arranged in a manner that removes road material to the same final cut depth. For example, the picks may be arranged such that a larger PDC of one pick follows a path of a smaller PDC of another pick. Hence, the smaller PDC may first remove road material to a first depth, and the larger PDC may subsequently remove additional road material to the second depth. Moreover, in some examples, operation of the milling drum may remove road material to the second (or final) depth produced by the larger PDCs.

Figure 5:
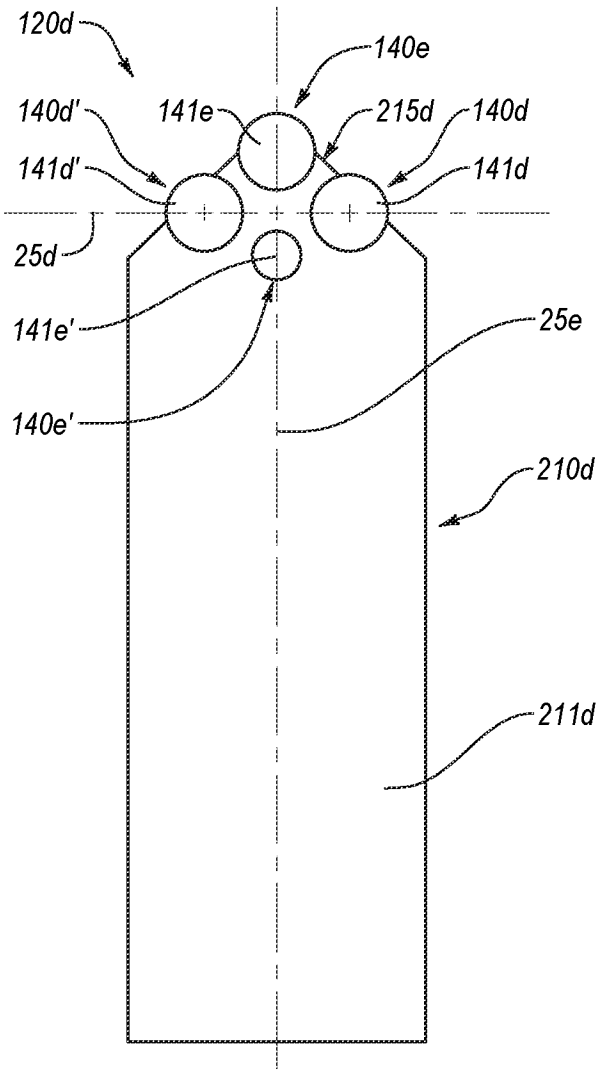
FIG. 5 is a front view of a pick according to one other embodiment.

In some embodiments, the pick may include multiple PDCs aligned along multiple centerlines. FIG. 5, for example, illustrates an embodiment of a pick 120*d* that includes PDCs 140*d*, 140*d*', 140*e*, 140*e*' attached to a pick body 210*d*. Except as otherwise described herein, the pick 120*d* and its materials, elements, or components may be similar to or the same as any of the picks 120, 120*a*, 120*b*, 120*c* (FIGS. 1A-4) and their respective materials, elements, and components. For example, at least some of the PDCs 140*d*, 140*d*', 140*e*, 140*e*' may be similar to or the same as the PDCs 140*b*, 140*b*' (FIG. 3).

In an embodiment, the PDCs 140*d*, 140*d*', 140*e* may form a pyramid-like or triangular configuration that may engage the road material. In particular, for instance, the PDCs 140*d*, 140*d*' may be aligned along a first reference line 25*d*, while the PDC 140*e* may lie on a second reference line 25*e*, which may be substantially perpendicular to the first reference line 25*d* (e.g., the center of the PDC 140*e* may be offset from the first reference line 25*d*). Also, in some examples, the second reference line 25*e* may generally coincide with a centerline of the pick body 210*d* (e.g., portions of the pick body on opposing sides of the second reference line 25*e* may be symmetrical mirror images of each other). Hence, in some instances, cutting surfaces or edges of the PDCs 140*d*, 140*d*' may engage the road material at a first depth, and the cutting edges and/or surfaces of the PDC 140*e* may engage the road material at a second depth. In some embodiment, the second depth (produced by the PDC 140*e*) may be greater than the first depth (produced by the PDCs 140*d*, 140*d*').

Furthermore, the PDCs 140*d*, 140*d*' may be spaced apart from each other and/or from the reference line 25*e*. For example, the width of cut or removed road material produced by the pick 120*d* may be at least partially defined by the distance between the outer cutting edges of PDCs 140*d*, 140*d*', while the depth of cut or removed road material may be defined by the PDC 140*e*. In an embodiment, the pick body 210*d* may have a tapered or angled top surface 215*d*. In some examples, the outer portions of the PDCs 140*d*, 140*d*', 140*e*, which may defined or determine the depth and/or width of cut or grove produced in the road material by the pick 120*d*, may protrude above and/or past the top surface 215*d* of the pick body 210*d*. In other words, under some operating conditions, the top surface 215*d* may not contact or fail the road material during operation of the pick 120*d*.

As noted above, the pick 120*d* may include the PDC 140*e*'. Particularly, in an embodiment, the PDC 140*e*' may be positioned on the pick body 210*d* in a manner that the PDC 140*e*' does not protrude past the top surface 215*d*. For example, the PDC 140*e*' may include a working surface 141*e*' that may protrude above or out of a front surface 211*d* of the pick body 210*d*, while the outer periphery or contour of the PDC 140*e*' may remain within the pick body 210*d*.

Also, in some examples, the PDC 140*e*' may be aligned along the reference line 25*e*. For example, centers of the PDCs 140*e*, 140*e*' may lie on the reference line 25*e*. As mentioned above, in some instances, the reference line 25*d* may be substantially parallel to the rotation axis of the milling drum and/or to the reconditioned surface produced by picks attached to the milling drum. As such, the reference line 25*e* may be substantially perpendicular to the rotation axis of the milling drum and/or to the reconditioned surface.

The working surface 141*e*' of the PDC 140*e*' may engage the road material and/or protect at least a portion of the pick body 210*d* from wear during operation. Similarly, PDCs 140*d*, 140*d*', 140*e* may include respective working surfaces 141*d*, 141*d*', 141*e*, which may also engage the road material and/or protect at least a portion of the pick body 210*d*. In any event, one or more of the PDCs 140*d*, 140*d*', 140*e*, 140*e*' may engage and fail road material and may protect the pick body 210*d* from wear. Furthermore, it should be appreciated that the pick may include any suitable number of PDCs, which may be arranged on the pick body in any number of suitable patterns or configurations.

Figure 6:
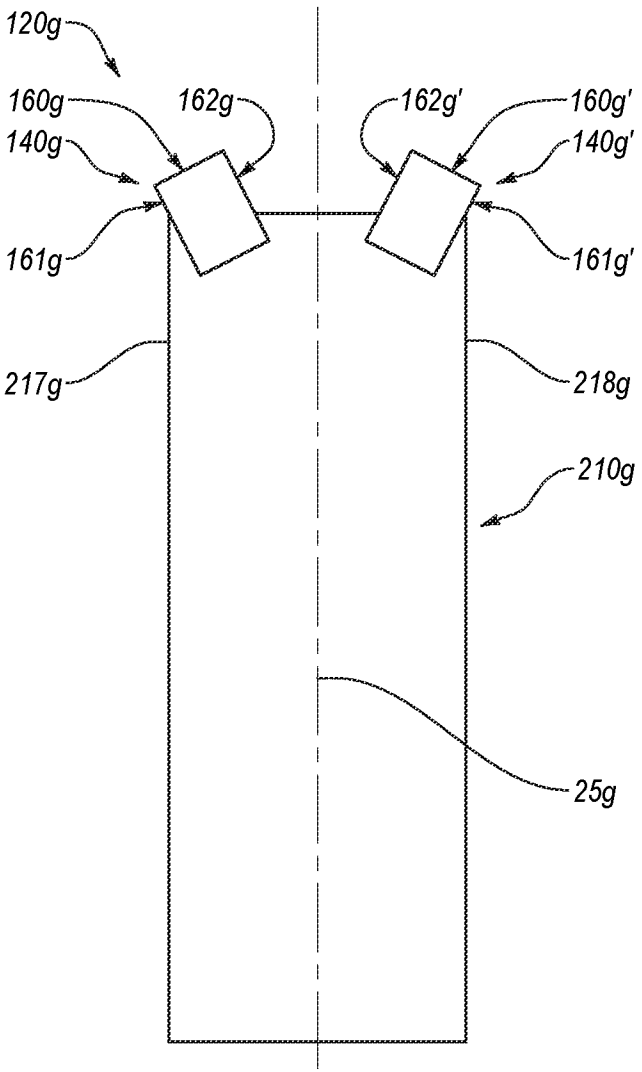
FIG. 6 is a front view of a pick according to still another embodiment.

Additionally, while the picks described above may include multiple cylindrical or approximately cylindrical PDCs, this disclosure is not so limited. For instance, FIG. 6 illustrates a pick 120*g* that includes non-cylindrical PDCs 140*g*, 140*g*' attached to a pick body 210*g*. Except as otherwise described herein, the pick 120*g* and its materials, elements, or components may be similar to or the same as any of the picks 120, 120*a*, 120*b*, 120*c*, 120*d* (FIGS. 1A-5) and their respective materials, elements, and components. For example, the pick body 210*g* may be similar to any of the pick bodies described herein.

Generally, the PDCs 140*g*, 140*g*' may be positioned at any suitable location on the pick body 210*g*, which may vary from one embodiment to the next. In an embodiment, PDCs 140*g*, 140*g*' of the pick 120*g* may be spaced apart from each other. For example, the PDCs 140*g*, 140*g*' may be positioned near opposing sides of the pick body 210*g* (e.g., the PDC 140*g* may be positioned near a first side 217*g* and the PDC 140*g*' may be positioned near a second side 218*g*.

As noted above, the PDCs 140*g*, 140*g*' may be approximately rectangular. Hence, in some embodiments, the PDCs 104*g*, 140*g*' may have respective cutting edges 160*g*, 161*g*, 162*g*, 160*g*', 161*g*', 162*g*'. In particular, in an embodiment, the cutting edges 160*g*, 161*g*, 162*g* may be approximately perpendicular to one another. Similarly, the cutting edges 160*g*', 161*g*', 162*g*' may be approximately perpendicular to one another. Also, one or more of the cutting edges 160*g*, 161*g*, 160*g*', 161*g*' may be exposed from the pick body 210*g* and may engage the road material.

Moreover, in an embodiment, one or more of the cutting edges 160*g*, 161*g*, 162*g*, 160*g*', 161*g*', 162*g*' may form an obtuse or acute angle relative to a center axis 25*g* and/or one or more of the first and second sides 217*g*, 218*g* of the pick body 210*g*. In some examples, the angles formed between the cutting edges 160*g*, 161*g*, 162*g*, 160*g*', 161*g*', 162*g*' and the centerline 25*g* (and/or first and/or second sides 217*g*, 218*g*) may be in one or more ranges described above in connection with the back rake angle.

In alternative embodiments, one or more of the cutting edges 160*g*, 161*g*, 162*g*, 160*g*', 161*g*', 162*g*' may be have a substantially perpendicular or parallel orientation relative to the center axis 25*g* and/or first and/or sides 217*g*, 218*g*. Also, as noted above, the PDCs 140*g*, 140*g*' may include a back rake angle and/or side rake angle. In some examples, back rake and side rake angles may be the same, while in other examples the back and side rake angles may be different from one another. Likewise, the angles formed by the cutting edges 160*g*, 161*g*, 162*g*, 160*g*', 161*g*', 162*g*' and, for instance, the centerline 25*g* may be the same as any of the back rake or side rake angles formed by the PDCs 140*g*, 140*g*' or different therefrom.

Figure 7:
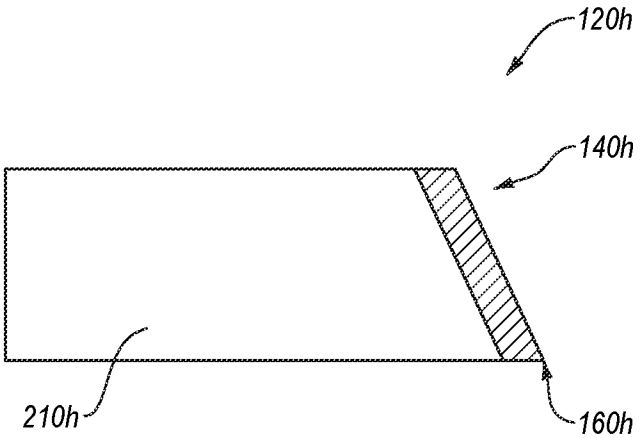
FIG. 7 is a side view of a pick according to at least one other embodiment.

FIG. 7 illustrates a pick 120*h* according to one or more additional or alternative embodiments. Except as otherwise described herein, the pick 120*h* and its materials, elements, or components may be similar to or the same as any of the picks 120, 120*a*, 120*b*, 120*c*, 120*d*, 120*g*, (FIGS. 1A-6) and their respective materials, elements, and components. For example, the pick 120*h* may include a PDC 140*h* secured to a pick body 210*h*. In some embodiments, the pick 120*h* may have a sharp (i.e., un-chamfered) cutting edge 160*h*. Moreover, in an embodiment, the pick body 210*h* may have no recess, and the PDC 140*h* may be attached to an un-recessed portion of the pick body 210*h*.

Figure 8:
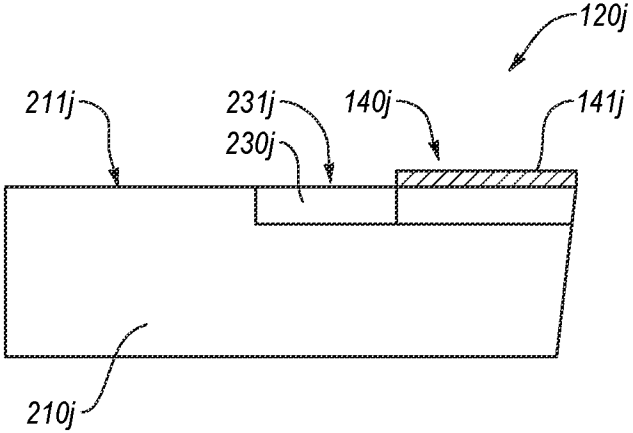
FIG. 8 is a side view of a pick according to still another embodiment.

FIG. 8 illustrates a pick 120*j* according to at least one embodiment. Except as otherwise described herein, the pick 120*j* and its materials, elements, or components may be similar to or the same as any of the picks 120, 120*a*, 120*b*, 120*c*, 120*d*, 120*g*, 120*h* (FIGS. 1A-7) and their respective materials, elements, and components. For example, the pick 120*j* may include a PDC 140*j* attached to a pick body 210*j*.

Furthermore, the PDC 140*j* may include a working surface 141*j*. As noted above, in an embodiment, the working surface 141*j* may have a zero degree rake angle (or no rake angle) when mounted on the milling drum. For example, the working surface 141*j* may be approximately parallel to a front face 211*j* of the pick body 210*j*. Additionally or alternatively, the working surface 141*j* may be offset from the front face 211*j* of the pick body 210*j*. In other words, the PDC 140*j* may protrude outward from the pick body 210*j* and the front face 211*j* thereof.

In some embodiments, the pick 120*j* may include a shield 230*j* that may be positioned near the PDC 140*j*. In an embodiment, a front face 231*j* of the shield 230*j* may be approximately coplanar with the front face 211*j* of the pick body. Hence, in an embodiment, the front face 231*j* of the shield may be recessed from the working surface 141*j* of the PDC 140*j* (e.g., in a manner that may reduce or minimize contact of the shield 230*j* with the road material during operation of the pick 120*j*.

Generally, the shield 230*j* may include any suitable material. In an embodiment, the shield 230*j* may include material(s) that may be harder and/or more wear resistant than the material(s) of the pick body 210*j*. For example, the shield 230*j* may include carbide, polycrystalline diamond, or other suitable material that may protect the portion of the pick body 210*j* located behind the shield 230*j*.

Figure 9:
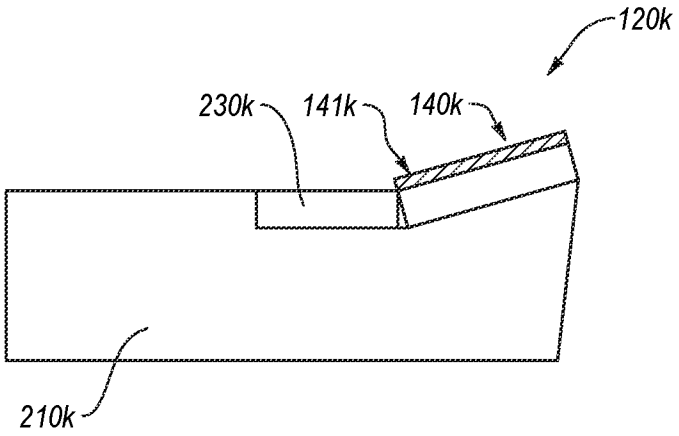
FIG. 9 is a side view of a pick according to one or more embodiments.

Additionally, in an embodiment, as shown in FIG. 9, as discussed above, a pick 120*k* may have a positive back rake angle. Except as otherwise described herein, the pick 120*k* and its materials, elements, or components may be similar to or the same as any of the picks 120, 120*a*, 120*b*, 120*c*, 120*d*, 120*g*, 120*h*, 120*j* (FIGS. 1A-8) and their respective materials, elements, and components. For example, the pick 120*k* may include a PDC 140*k* that has a working surface 141*k*, which may be oriented at a positive back rake angle during operation of the pick 120*k*. In an embodiment, a pick body 210*k* of the pick 120*k* may orient the PDC 140*k* in a manner that the working surface 141*k* forms a positive back rake angle during operation.

Furthermore, in some embodiments, the pick 120*k* may include a shield 230*k*, which may be similar to the shield 230*j* (FIG. 8). For instance, the shield 230*k* may be positioned near and may abut the PDC 140*k*. As such, the shield 230*k* may shield or protect from wear a portion the pick body 230*k* that is near the PDC 140*k*.

Figure 10:
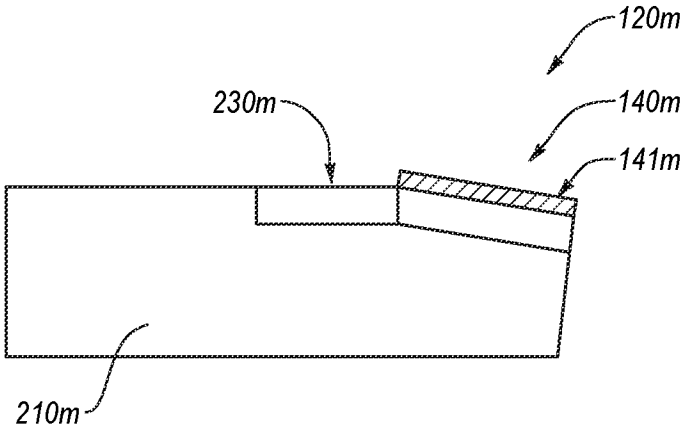
FIG. 10 is a side view of a pick according to an embodiment.

As mentioned above, the pick may have a working surface that has a positive back rake angle. FIG. 10, for example, illustrates a pick 120*m* that includes a PDC 140*m* attached to a pick body 210*m*. Except as otherwise described herein, the pick 120*m* and its materials, elements, or components may be similar to or the same as any of the picks 120, 120*a*, 120*b*, 120*c*, 120*d*, 120*g*, 120*h*, 120*j*, 120*k* (FIGS. 1A-9) and their respective materials, elements, and components. For instance, the pick 120*m* may include a shield 230*m*, which may be similar to or the same as the shield 230*j* (FIG. 8). In an embodiment, the PDC 140*m* may include a working surface 141*m*, which may form a negative back rake.

Figure 11:
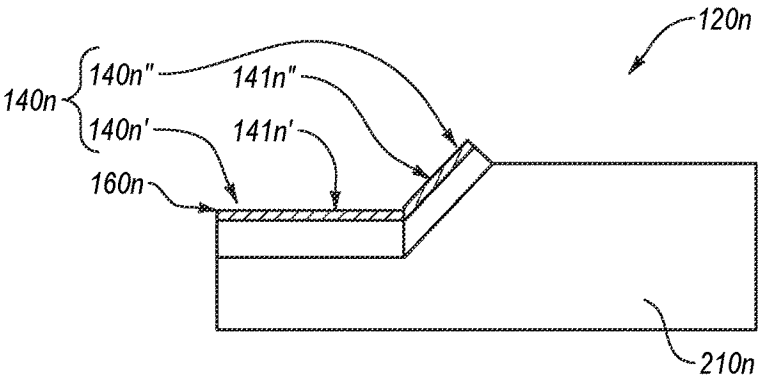
FIG. 11 is a side view of a pick according to yet another embodiment.

FIG. 11 illustrates a pick 120*n* according to an embodiment. Except as otherwise described herein, the pick 120*n* and its materials, elements, or components may be similar to or the same as any of the picks 120, 120*a*, 120*b*, 120*c*, 120*d*, 120*h*, 120*g*, 120*j*, 120*k*, 120*m* (FIGS. 1A-10) and their respective materials, elements, and components. For example, the pick 120*n* may include one or more PDCs 140*n* attached to a pick body 210*n*. More specifically, in an embodiment, the pick 120*n* includes a first PDC 140*n*' and a second PDC 140*n*". In an embodiment, the first and second PDCs 140*n*', 140*n*" may be oriented relative to each other at a non-parallel angle. For instance, the first and second PDCs 140*n*', 140*n*" may form an obtuse angle therebetween.

In an embodiment, the first PDC 140*n*' may include a cutting edge 160*n*. Furthermore, the first and second PDCs 140*n*', 140*n*" may include respective working faces 141*n*', 141*n*". More specifically, in an embodiment, the working faces 141*n*', 141*n*" may fail road material and/or deflect failed road material away from the pick 120*n*. Additionally or alternatively, the second PDC 140*n*" may protect at least a portion of the pick body 120*n*. For example, the second PDC 140*n*" may protect a portion of the pick body 210*n* near the first PDC 140*n*'.

Figure 12:
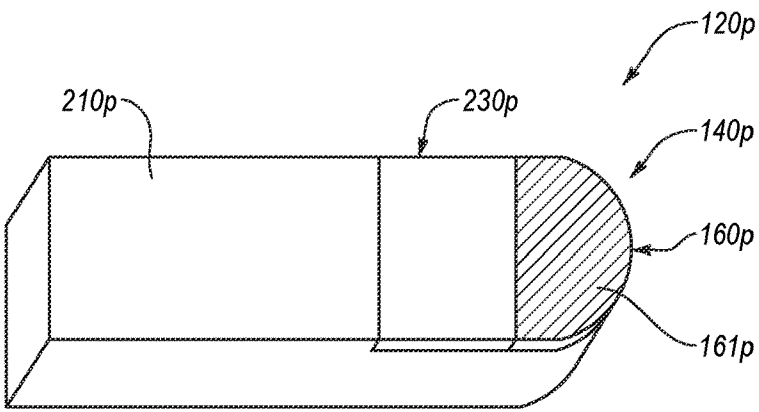
FIG. 12 is an isometric view of a pick according to still one other embodiment.

While at least one of the above described embodiments includes a linear cutting edge, it should be appreciated that this disclosure is not so limited. For instance, FIG. 12 illustrates a pick 120*p* that may have a non-linear cutting edge 160*p*. Except as otherwise described herein, the pick 120*p* and its materials, elements, or components may be similar to or the same as any of the picks 120, 120*a*, 120*b*, 120*c*, 120*d*, 120*h*, 120*g*, 120*j*, 120*k*, 120*m*, 120*n* (FIGS. 1A-11) and their respective materials, elements, and components. For example, the pick 120*k* may include an approximately semicircular cutting edge 160*p*.

In an embodiment, the cutting edge 160*p* may be at least partially formed by a PDC 140*p*, which may be secured to a pick body 210*p*. Furthermore, the cutting edge 160*p* may at least partially define the perimeter of the PDC 140*p*. Hence, in at least one embodiment, the PDC 140*p* may have a semicircular shape that may protrude away from the pick body 210*p*.

In some instances, the pick 120*p* may include a shield 230*p*, which may be similar to or the same as the shield 230*j* (FIG. 8). Moreover, in one example, the shield 230*p* may abut the PDC 140*p*. For example, the PDC 140*p* and the shield 230*p* may have approximately straight sides that may be positioned next to each other and/or may abut each other on the pick body 230*p* (i.e., a bottom side of the PDC 140*p* and a top side of the shield 230*p*).

Figure 13:
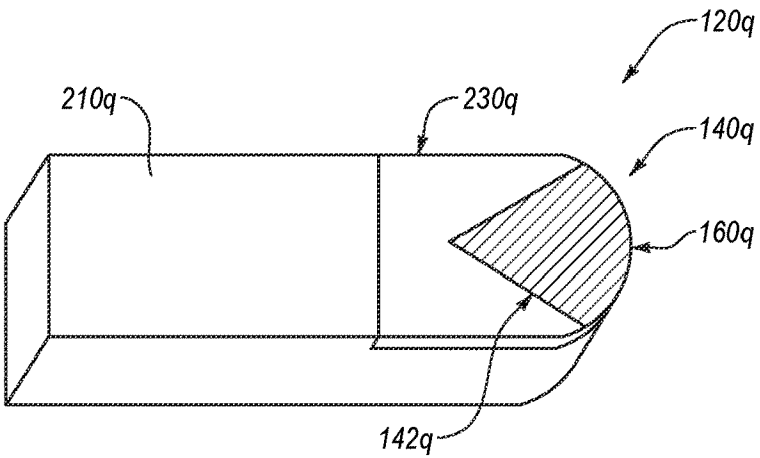
FIG. 13 is an isometric view of a pick according to at least one embodiment.

Alternatively, the bottom side of the PDC may be nonlinear and/or not straight. For instance, FIG. 13 illustrates a pick 120*q* that includes a PDC 140*q* attached to a pick body 210*q*. Except as otherwise described herein, the pick 120*q* and its materials, elements, or components may be similar to or the same as any of the picks 120, 120*a*, 120*b*, 120*c*, 120*d*, 120*h*, 120*g*, 120*j*, 120*k*, 120*m*, 120*n*, 120*p* (FIGS. 1A-12) and their respective materials, elements, and components. For example, the pick 120*q* may include a rounded cutting edge 160*q*, at least a portion of which may be on the PDC 140*q*.

In an embodiment, a bottom side 142*q* of the PDC 140*q* may be nonlinear or may include multiple linear segments. In one example, the pick 120*q* may include a shield 230*q* that may be secured to the pick body 230*q*. Furthermore, the shield 230*q* may abut at least a portion of the bottom side 142*q* of the PDC 140*q*. Accordingly, in at least one embodiment, the shield 230*q* may have a nonlinear top side that may abut or may be positioned near the bottom side 230*q* of the PDC 140*q*. For instance, the top side of the shield 230*q* may have a shape and side that may be complementary to the shape and size of the bottom side 142*q* of the PDC 140*q*, such that at least a portion of the PDC 140*q* may fit inside the shield 230*q* and/or at least a portion of the shield 230*q* may fit into the PDC 140*q*. In one or more embodiments, the bottom side 142*q* of the PDC 140*q* may have a convex shape (e.g., V-shaped convex), and the top side of the shield 230*q* may have a corresponding concave shape, which may receive the convex shape of the bottom side 142*q*.

Figure 14:
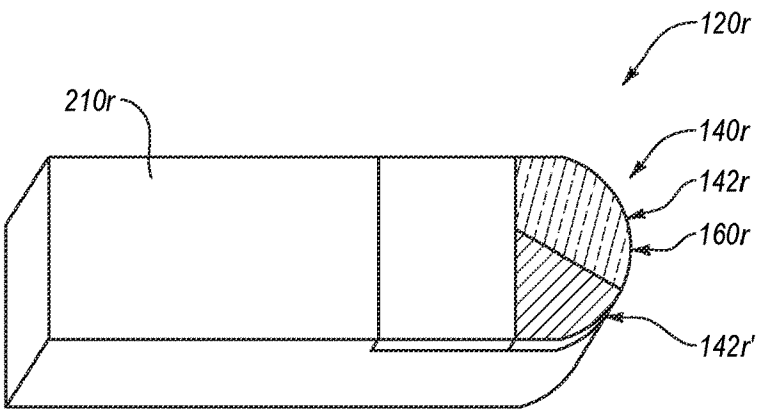
FIG. 14 is an isometric view of a pick according to yet another embodiment.

In an embodiment, the PDC may include multiple materials. FIG. 14, for instance, illustrates a pick 120*r* that includes a PDC 140*r* attached to a pick body 210*r*. Except as otherwise described herein, the pick 120*r* and its materials, elements, or components may be similar to or the same as any of the picks 120, 120*a*, 120*b*, 120*c*, 120*d*, 120*h*, 120*g*, 120*j*, 120*k*, 120*m*, 120*n*, 120*p*, 120*q* (FIGS. 1A-13) and their respective materials, elements, and components. In an embodiment, the PDC 140*r* may include two PCD components 142*r*, 142*r*' bonded to a substrate. Collectively, the PCD components 142*r*, 142*r*' may form a cutting edge 160*r*. In an embodiment, the two PCD components 142*r*, 142*r*' may be formed from different types of PCD materials that may exhibit different wear resistances and/or thermal stabilities.

Figure 15:
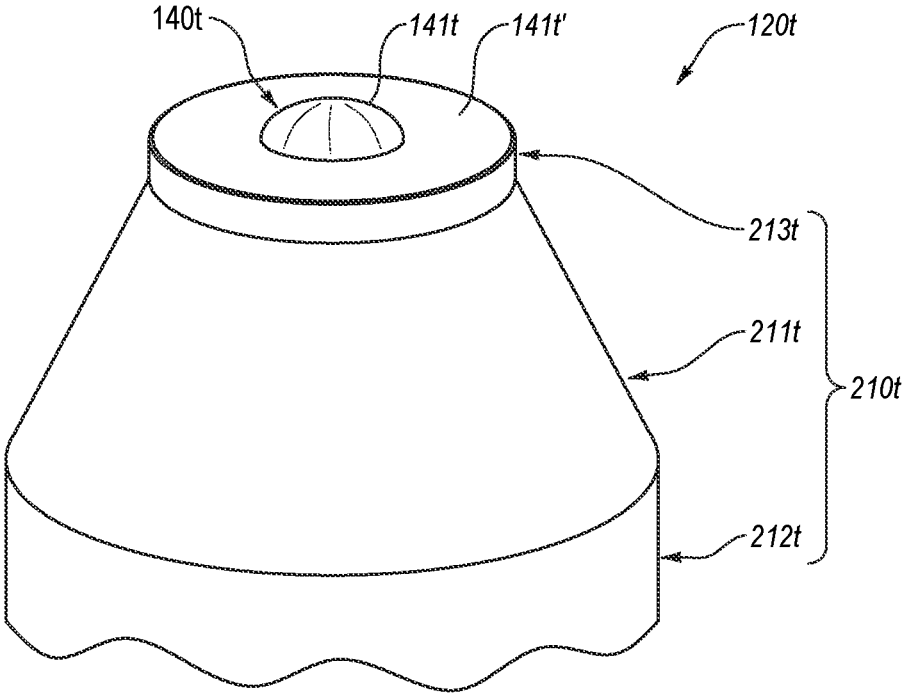
FIG. 15 is an isometric view of a pick according to one or more embodiments.

While in one or more embodiments the pick body may have an approximately rectangular or square cross-sectional shape, this disclosure is not so limited. FIG. 15, for example, illustrates a portion of a pick 120*t* that includes a PDC 140*t*. Except as otherwise described herein, the pick 120*t* and its materials, elements, or components may be similar to or the same as any of the picks 120, 120*a*, 120*b*, 120*c*, 120*d*, 120*h*, 120*g*, 120*j*, 120*k*, 120*m*, 120*n*, 120*p*, 120*q*, 120*r* (FIGS. 1A-14) and their respective materials, elements, and components. For example, the pick 120*t* may include a pick body 210*t* that has an approximately circular cross-sectional shape.

For instance, the pick body 210*t* may include a conical portion 211*t* and a first cylindrical portion 212*t* connected to or integrated with the conical portion 211*t*. In an embodiment, the first cylindrical portion 212*t* may extend from a major diameter of the conical portion 211*t*. In at least one embodiment, the pick body 210*t* may include a second cylindrical portion 213*t*. For example, the second cylindrical portion 213*t* may extend from a minor diameter of the conical portion 211*t*.

In an embodiment, the PDC 140*t* may include a working surface 141*t*, which may include polycrystalline diamond. For instance, the working surface 141*t* may have a semi-spherical or dome shape that extends or protrudes from a second cylindrical portion 213*t*. In an embodiment, the second cylindrical portion 213*t* may include an approximately planar working surface 141*e*, which may engage the target road material. Hence, in an embodiment, the working surface 141*t* of the PDC 140*t* may protrude above the working surface 141*e*.

The pick body 210*t* may include any number of suitable materials and combinations of materials, which may vary from one embodiment to the next. In at least one embodiment, the pick body 210*t* includes cemented carbide material. Thus, for example, the second cylindrical portion 213*t* of the pick body 210*t* may form a substrate. Moreover, in an example, the PDC 140*t* may include polycrystalline diamond table that may be bonded to the second cylindrical portion 213*t* of the pick body 210*t*.

In an embodiment, the domed working surface 141*t* may facilitate rotation of the pick 120*t* during operation thereof (i.e., the pick 120*t* may rotatably fail target road material). For example, the PDC 140*t* may be rotatably mounted to a pick body 210*t* in a manner that allows the PDC 140*t* to rotate during operation of the pick 120*t* (e.g., when the working surface 141*t* engages the target material). In an embodiment, the second cylindrical portion 213*t* of the pick body 210*t* may rotate together with the working surface 141*t* relative to the remaining portions of the pick body 210*t*, such as relative to the conical portion 211*t*. Rotating the working surface 141*t* during operation of the pick 120*t* may extend the useful life of the pick 120*t* (e.g., by distributing the wear around the entire working surface 141*t*).

Generally, the PCD and PCD tables of the picks described herein may vary from one embodiment to the next. In an embodiment, the PCD table includes a plurality of bonded diamond grains defining a plurality of interstitial regions. A metal-solvent catalyst may occupy the plurality of interstitial regions. The plurality of diamond grains and the metal-solvent catalyst collectively may exhibit a coercivity of about 115 Oersteds ("Oe") or more and a specific magnetic saturation of about 15 Gauss·cm$^3$/grams ("G·cm$^3$/g") or less. Additionally, in an embodiment, the PCD table may include a plurality of diamond grains defining a plurality of interstitial regions. A metal-solvent catalyst may occupy the plurality of interstitial regions. The plurality of diamond grains and the metal-solvent catalyst collectively may exhibit a specific magnetic saturation of about 15 G·cm$^3$/g or less. The plurality of diamond grains and the metal-solvent catalyst may define a volume of at least about 0.050 cm$^3$. Additional description of embodiments for the above described PCD table is provided in U.S. Pat. No. 7,866,418, which is incorporated herein, in its entirety, by this reference.

In an embodiment, the PDC may include a preformed PCD volume or PCD table, as described in more detail in U.S. Pat. No. 8,236,074, which is incorporated herein in its entirety by this reference. For example, the PCD table that may be bonded to the substrate by a method that includes providing the substrate, the preformed PCD volume, and a braze material and at least partially surrounding the substrate, the preformed PCD volume or PCD table, and a braze material within an enclosure. Also, the enclosure may be sealed in an inert environment. Furthermore, the enclosure may be exposed to a pressure of at least about 6 GPa and, optionally, the braze material may be at least partially melted.

In yet another embodiment, a PDC may include a substrate and a pre-formed PCD table that may include bonded diamond grains defining a plurality of interstitial regions, and which may be bonded to the substrate, as described in further detail in U.S. patent application Ser. No. 13/070,636 (issued as U.S. Pat. No. 8,727,044 on May 20, 2014), which is incorporated herein in its entirety by this reference. For instance, the preformed PCD table may further include an upper surface, a back surface bonded to the substrate, and at least one lateral surface extending between the upper surface and the back surface. A region may extend inwardly from the upper surface and the at least one lateral surface. The region may include at least a residual amount of at least one interstitial constituent disposed in at least a portion of the interstitial regions thereof. The at least one interstitial constituent may include at least one metal carbonate and/or at least one metal oxide. Additionally, a bonding region may be placed adjacent to the substrate and extending inwardly from the back surface. The bonding region may include a metallic infiltrant and a residual amount of the at least one interstitial constituent disposed in at least a portion of the interstitial regions thereof.

In another embodiment, the PCD table of the PCD may include a plurality of diamond grains exhibiting diamond-to-diamond bonding therebetween and defining a plurality of interstitial regions as described in more detail in U.S. patent application Ser. No. 13/027,954 (issued as U.S. Pat. No. 9,017,438 on Apr. 28, 2015), which is incorporated herein in its entirety by this reference. For instance, the PCD table may include at least one low-carbon-solubility material disposed in at least a portion of the plurality of interstitial regions. The at least one low-carbon-solubility material may exhibit a melting temperature of about 100° C. or less and a bulk modulus at 20° C. of less than about 150 GPa.

In an additional or alternative embodiment, the PCD table of the PCD 140*q* may include a plurality of bonded-together diamond grains defining a plurality of interstitial regions as described in more detail in U.S. patent application Ser. No. 13/100,388 (issued as U.S. Pat. No. 9,027,675 on May 12, 2015), which is incorporated herein in its entirety by this reference. For instance, the PCD table may include aluminum carbide disposed in at least a portion of the plurality of interstitial regions. Moreover, in an embodiment, the PCD table may include a plurality of bonded diamond grains that may exhibit an average grain size of about 40 μm or less.

In an embodiment, the preformed PCD table may include at least a portion of the interstitial regions of the first region including an infiltrant disposed therein, as described in more detail in U.S. patent application Ser. No. 12/961,787 (published as U.S. Patent Publication No. U.S. 2012/0138370 on Jun. 7, 2012), which is incorporated herein in its entirety by this reference. In some embodiments, the pre-formed PCD table may also include a second region adjacent to the first region and extending inwardly from the exterior working surface to a depth of at least about 700 μm. In some instances, the interstitial regions of the second region may be substantially free of the infiltrant. In one example, the preformed PCD table may have a nonplanar interface located between the first and second regions.

In an embodiment, the PCD table may include a plurality of bonded diamond grains defining a plurality of interstitial regions and at least a portion of the plurality of interstitial regions may include a cobalt-based alloy disposed therein as described in more detail in U.S. application Ser. No. 13/275,372 (issued as U.S. Pat. No. 9,272,392 on Mar. 1, 2016) and Ser. No. 13/648,913 (issued as U.S. Pat. No. 9,487,847 on Nov. 8, 2016), each of which is incorporated herein in its entirety by this reference. In some examples, a cobalt-based alloy may include at least one eutectic forming alloying element in an amount at or near a eutectic composition for an alloy system of cobalt and the at least one eutectic forming alloying element.

In some embodiments, the PCD table of the PDC may include an interfacial surface bonded to a cemented carbide substrate and an upper surface and an infiltrant, which may be disposed in at least a portion of a plurality of interstitial regions. For instance, the infiltrant may include an alloy comprising at least one of nickel or cobalt, at least one of carbon, silicon, boron, phosphorus, cerium, tantalum, titanium, niobium, molybdenum, antimony, tin, or carbides thereof, and at least one of magnesium, lithium, tin, silver, copper, nickel, zinc, germanium, gallium, antimony, bismuth, or gadolinium.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A pick for removing a road material, the pick comprising:

a pick body; and a plurality of polycrystalline diamond compacts ("PDCs") attached to the pick body, at least one of the plurality of PDCs comprising:

a diamond table having a domed working surface; and a substrate comprising a first cylindrical portion attached to the pick body, the first cylindrical portion exhibiting a cylindrical shape with a distal planar surface, the cylindrical shape having a diameter that is greater than a thickness of the substrate, the diamond table being mounted on and being at least partially laterally encompassed by the distal planar surface of the substrate, the substrate defining a second working surface including the distal planar surface, wherein the domed working surface borders and protrudes from the second working surface of the substrate, wherein the domed working surface is positioned directly adjacent to the distal planar surface of the substrate.

2. The pick of claim 1, wherein the pick body defines a longitudinal axis, at least a portion of the pick body that defines the longitudinal axis is configured to be mounted in at least one of a holder or a mounting base of a milling drum.

3. The pick of claim 1, wherein the pick body includes cemented carbide.

4. The pick of claim 1, wherein each of the plurality of PDCs exhibits a domed working surface.

5. The pick of claim 1, wherein each of the plurality of PDCs exhibits the same shape and size.

6. The pick of claim 1, wherein at least two of the plurality of PDCs exhibit a different shape and size.

7. The pick of claim 6, wherein each of the plurality of PDCs exhibit a different size.

8. The pick of claim 1, wherein a center of each of the plurality of PDCs are aligned along a reference line.

9. The pick of claim 8, wherein the reference line is parallel to the planar surface of the substrate.

10. The pick of claim 1, wherein each of the plurality of PDCs protrude above the planar surface of the substrate.

11. The pick of claim 1, wherein the plurality of PDCs are spaced from each other.

12. The pick of claim 1, wherein the pick body includes a conical portion and the first cylindrical portion extending from a minor diameter of the conical portion, at least one of the plurality of PDCs extending from a portion of the pick body that is closer to the minor diameter of the conical portion than a major diameter of the conical portion, and wherein the pick body exhibits an outermost lateral surface having a discontinuous shape at an interface between the conical portion and the first cylindrical portion.

13. The pick of claim 12, wherein the first cylindrical portion exhibits a right cylinder shape.

14. The pick of claim 13, wherein the at least one of the plurality of PDCs is bonded to the first cylindrical portion.

15. The pick of claim 1, wherein the at least one of the plurality of PDCs that exhibits the domed working surface and the substrate are rotatably mounted to the pick body.

16. The pick of claim 1, wherein each of the plurality of PDCs is brazed to the pick body.

17. The pick of claim 16, wherein at least a top portion of the substrate on which the at least one of the plurality of PDCs is mounted is exposed outside of the pick body.

18. A method of removing road material, the method comprising:

advancing a plurality of picks toward the road material, at least one of the plurality of picks including:

a pick body; and a plurality of polycrystalline diamond compacts ("PDCs") attached to the pick body, at least one of the plurality of PDCs exhibiting a domed working surface at least partially laterally encompassed by and fixedly coupled to a second working surface; and advancing the domed working surface of the at least one pick into the road material;

at least partially rotating the domed working surface and the second working surface fixedly coupled thereto together in unison relative to the pick body as the domed working surface contacts the road material; and failing at least some of the road material with at least one of the domed working surface of the at least one of the plurality of PDCs or the second working surface.

19. A system for removing a road material, the system comprising:

a milling drum rotatable about a rotation axis; and a plurality of picks mounted on the milling drum, at least one of the plurality of picks including:

a pick body; and a plurality of polycrystalline diamond compacts ("PDCs") attached to the pick body, at least one of the plurality of PDCs comprising:

a diamond table having a domed working surface; and a substrate comprising a first cylindrical portion attached to the pick body, the first cylindrical portion exhibiting a cylindrical shape with a distal planar surface, the cylindrical shape having a diameter that is greater than a thickness of the substrate, the diamond table being mounted on and being at least partially laterally encompassed by the distal planar surface of the substrate, the substrate defining a second working surface including the distal planar surface, wherein the domed working surface borders and protrudes from the second working surface of the substrate, wherein the domed working surface is positioned directly adjacent to the distal planar surface of the substrate.

20. The system of claim 19, wherein:

the milling drum includes at least one of a holder or a mounting base; and the pick body defines a longitudinal axis, at least a portion of the pick body that defines the longitudinal axis being mounted in at least one of the holder or the mounting base of the milling drum.

* * * * *